US012076603B2

(12) United States Patent
Acri

(10) Patent No.: US 12,076,603 B2
(45) Date of Patent: Sep. 3, 2024

(54) EXERCISE APPARATUS, SYSTEM, AND METHODS OF ASSEMBLY, DISASSEMBLY, AND USE

(71) Applicant: Austin A. Acri, Carlsbad, CA (US)

(72) Inventor: Austin A. Acri, Carlsbad, CA (US)

( * ) Notice: Subject to any disclaimer, the term of this patent is extended or adjusted under 35 U.S.C. 154(b) by 0 days.

(21) Appl. No.: 18/141,858

(22) Filed: May 1, 2023

(65) Prior Publication Data

US 2023/0347197 A1 Nov. 2, 2023

Related U.S. Application Data

(60) Provisional application No. 63/455,336, filed on Mar. 29, 2023, provisional application No. 63/363,903, filed on Apr. 29, 2022.

(51) Int. Cl.
*A63B 21/072* (2006.01)
*A63B 21/00* (2006.01)

(52) U.S. Cl.
CPC ..... *A63B 21/072* (2013.01); *A63B 21/4035* (2015.10)

(58) Field of Classification Search
CPC ..... A63B 21/072; A63B 21/0722; A63B 21/0724; A63B 21/0726; A63B 21/0728; A63B 21/075; A63B 21/4035
See application file for complete search history.

(56) References Cited

U.S. PATENT DOCUMENTS 4,252,316 A * 2/1981 Price ..... A63B 21/0724 482/106
4,431,185 A 2/1984 Cisneros
7,137,930 B1 11/2006 Carr
(Continued)

FOREIGN PATENT DOCUMENTS

CN 213313138 U 6/2021
CN 213555133 U 6/2021
WO 2015020984 2/2015

OTHER PUBLICATIONS 4 in 1 Adjustable Dumbbell Set with Curl Bar and Kettlebellhttps://smittiesemporium.com/product/adjustable-dumbbell-set-with-curl-bar-kettlebell-barbell-weight-set.
(Continued)

*Primary Examiner* — Joshua Lee
(74) *Attorney, Agent, or Firm* — Holland & Hart LLP

(57) ABSTRACT

Exercise apparatus and methods of making, assembly, disassembly, and use. In one embodiment, exercise apparatus has a central weight base to which one or more weight plates and one or more exercise accessories may be removably mounted. The exercise accessories can including one or more U-shaped or otherwise shaped handles, a T-lifting-bar, an EZ lifting bar, and connectors to variously connect to yet other exercise devices such as, for example, weights, straps, ropes, resistance bands, pulleys, chains, or other structure. Further, the accessories may include or be connected to structure other than the central weight base, such as one or more of the accessories identified herein. Embodiments of the present specification can be, and can be combined with other exercise systems, to provide an exercise system that provides one or more of, to all of: a more versatile, customizable, compact, space-saving, economical, portable, and effective workout system and experience.

20 Claims, 27 Drawing Sheets

(56) References Cited

U.S. PATENT DOCUMENTS

| | | | | |
|---|---|---|---|---|
| 9,504,866 | B2 * | 11/2016 | Peralo | A63B 21/4035 |
| 9,844,695 | B1 | 12/2017 | Shorter | |
| 10,029,142 | B2 * | 7/2018 | Koenig | A63B 21/072 |
| 10,799,753 | B2 * | 10/2020 | Koenig | A63B 21/072 |
| 11,052,281 | B2 | 7/2021 | Saldate et al. | |
| 2002/0098955 | A1 | 7/2002 | Greene | |
| 2015/0174445 | A1 | 6/2015 | Robertson, Jr. | |
| 2015/0335935 | A1 * | 11/2015 | Peralo | A63B 21/012 482/93 |
| 2016/0144219 | A1 * | 5/2016 | Koenig | A63B 21/075 482/93 |
| 2019/0022451 | A1 | 1/2019 | Koenig | |
| 2020/0147439 | A1 | 5/2020 | Acuna, Jr. | |
| 2020/0222746 | A1 | 7/2020 | Obray et al. | |
| 2023/0145445 | A1 * | 5/2023 | Boatner | A63B 21/0724 482/106 |

OTHER PUBLICATIONS

International Search Report and Written Opinion of The International Searching Authority for International Application PCT/US2023/020600, mailed Jul. 17, 2023.

* cited by examiner

EXERCISE APPARATUS, SYSTEM, AND METHODS OF ASSEMBLY, DISASSEMBLY, AND USE

CROSS-REFERENCE TO RELATED APPLICATIONS

The present Nonprovisional Patent Applications claims priority through the applicant's prior U.S. Provisional Patent Applications: Ser. No. 63/363,903, filed Apr. 29, 2022, and entitled EXERCISE APPARATUS, SYSTEM, AND METHOD OF USE; and Ser. No. 63/455,336, filed Mar. 29, 2023, and entitled EXERCISE APPARATUS, SYSTEM, AND METHOD OF USE. Both of such prior Provisional patent applications are incorporated herein in their entirety, except that, in the event of any inconsistency between the present Nonprovisional patent application and any such prior Provisional Patent Application, the present Nonprovisional patent application shall govern.

TECHNICAL FIELD

This specification is directed to exercise apparatus and methods of assembly, disassembly, use of exercise apparatus, including, among other things, for exercise apparatus that can utilize conventional or other weight plates to provide differing types of exercise apparatus structures.

BRIEF SUMMARY OF SOME ASPECTS OF THE BACKGROUND

Conventional weight-lifting weight plates have long included circular weight plates or disks with tubular weight lifting bar passages penetrating the center of the plates. These types of circular or disk-shaped weight plates have been most commonly utilized with various types of weight lifting bars, including relatively short barbell bars and much longer bars. Often, the bars have threaded opposed ends to which threaded nuts can be threaded in order to secure one or more weight plates in position on the weight lifting bar.

The prior art has long also included exercise apparatus for adapting use of conventional weight plates to provide differing type of exercise structures. For example, U.S. Published Patent Application 2015/0174445 to Robertson discloses an adjustable exercise device having a handle removably attached to an upper end of a weight plate stacking pole having a weight support plate attached to the lower end of the stacking pole. The amount of weight in the device is adjustable by adjusting the number of weight plates mounted to the stacking pole. Differing types of handles can be attached to the upper end of the staking pole, such as a closed triangle (kettle bell) handle, a straight bar, and an angled or wave-shaped (EZ) bar.

The Robertson apparatus is quite limited, however, in the variety of exercise handles or other exercise devices and accessories that are attachable to the Robertson apparatus, including by limiting mounting of accessories only to the upper end of the Robertson weight stacking pole. Also, the upwardly extending Robertson weight mounting and length extension tubes are not solid components, reducing the weight of the Robertson apparatus. The Robertson apparatus also has a relatively large outwardly protruding tube locking pin which could harmfully catch on the user's clothes or skin during use.

U.S. Pat. No. 9,844,695 to Shorter provides a central base mount to which conventional weight plates can be mounted with one or more U-shaped handles extending radially outwardly from the central base. The Shorter apparatus is limited, however, to only having U-shaped handles that extend radially outwardly from the central base mount and thus is limited in the types of exercises that can be done with it. Further, Shorter's U-shaped handles are difficult to mount and remove from the base mount.

U.S. Published Patent Application 2019/0022451 to Koenig also discloses a two handle bell-like exercise apparatus that can utilize conventional weight plates. The two-handle structure of Koenig is, however, also limited in what can be done with it; and it is bulky including by having the two handles extend from a support stem spacing the handles from the bell-like weight. Although Koenig also discloses a differing type of bell-like weight or weight system that can have differing types of exercise handles and lifting structures attached to its upper end, this differing structure does not utilize conventional weight plates.

Conventional kettlebell weights have long included a single U-shaped handle co-molded with the ball-like bell weight. The handle has typically extended outwardly from the ball-like bell weight in a plane extending radially outwardly from the center of the ball-like bell weight. This orientation often limits what can be done with the device without risk of possibly damaging contact of the ball-like bell weight with the user.

One prior art kettlebell of U.S. Pat. No. 9,616,269 to Burosh has two opposed U-shaped handles extending outwardly from a central ball-like kettlebell. This ball-like kettlebell, however, has a central passage penetrating the ball-like bell in order to mount the kettlebell to a weight lifting bar. The central passage in the kettlebell means that the kettlebell is, itself, lighter in weight than is otherwise desirable for exercises with the kettlebell by itself, given its size as compared to the weight of other kettlebells having the same general size and composition. Further, the opposed U-shaped handles extend outwardly from the ball-like bell weight in a plane extending radially outwardly from the center of the ball-like bell weight. As noted above, this orientation often limits what can be done with the device without risk of possibly damaging or irritating contact of the ball-like bell weight with the user.

In addition, prior art fitness equipment often provides fixed connections between equipment handles, as in kettlebells for example, and structure limiting the ability to connect the equipment to other structure, thus limiting the range of exercises that can be performed with the equipment. Additionally, prior art kettlebells are unitary structures, requiring users to purchase and store multiple kettlebells of varying weights, leading to a cluttered workout space and increased costs.

BRIEF SUMMARY OF SOME ASPECTS OF THE DISCLOSURE

The inventor believes he has discovered the issues with the prior art identified above or their severity, and yet other issues and limitations of prior art exercise equipment. The applicant has therefore developed, among other things disclosed herein, a set of exercise apparatus components that can be mixed and matched to accomplish a greater range of exercises that typically provided by prior art exercise apparatus. In some embodiments, the exercise apparatus provides a central weight base having (i) a first weight mounting side section opposite a second weight mounting side section; (ii) a plurality of exercise accessory mounts; and (iii) one or more exercise accessories removably mountable to the system accessory mounts on the central weight mounting base.

In some embodiments, one or more weights are removably mountable to the first or second weight mounting section on the central weight base.

In some embodiments, a variety of differing types of exercise accessories can be removably mounted to the central weight base, facilitating the use the central weight base and differing exercise accessories to engage in differing exercises with the differing exercise accessories if desired. In some embodiments, the central weight base and one or more accessories can consume relatively little space, such as in a closet or relatively small section of a room for example.

In some applications, the first and second opposed weight mount side sections are adapted to receive one or more weights having a plate-shaped section, and at least one or more of a plurality of accessory mounts are in the central weight base are at least partially intermediate the first and second weight mount side sections. In some instances, the one or more weights are plate shaped, and in some applications, the one or more weight plates can have central mounting passage(s) that, in some instances, penetrate parallel opposed sides of the one or more weight plates. In some instances, the weight plates can be conventional weight-lifting weights of the type having weight mounting passages mountable to conventional or other weight-lifting bars.

Some of the present systems can thus include use with a barbell or other weight lifting bar system, and weights from the barbell or other weight lifting system can be alternatively mounted to the central weight base. In some embodiments, weight plates with central passages may be mounted to the central weight base by means of a bolt threadable in a section of the central weight base or, in some embodiments, a weight mounting bar mounted in the central weight base and one or more locking nuts for securing one or more weight plates in position with respect to the weight mounting bar.

In some embodiments, one a more weight plates may be secured to the central mounting base by one or more screws, such as a set screw for example, or pins penetrating the central mounting base and lockingly abutting a portion of the one more weight plates. Some instances may provide one or more weight plates with threaded sections threadably mountable in one or more matingly threaded sections in the central weight base. In addition, in some instances the or another threaded section on one or more weight plates can be mounted to a matingly threaded section on another weight plate.

In some systems, the exercise accessories removably mountable to the central mounting base can include one or more of the following: one more (i) U-shaped or otherwise rounded or shaped handles or bars, optionally mountable with differing orientations with respect to the central mounting base or to other accessories, such as with a portion of the handle or bar having an axis at an obtuse angle to an axis of a portion of another U-shaped handle or otherwise rounded or shaped handle or bar for example; (ii) a T-shaped lifting bar; (iii) an EZ weight lifting bar (which, in some instances, may be rotatable and locked in place in differing orientations with respect to the central mounting base); (iii) other removable connectors or accessories, such as for example connectors for connecting to other exercise accessories, such as one or more ropes, bars, straps, chains, or other weights.

In some embodiments, the accessories adapted for mounting to the central base may alternatively be removably connectable to yet other structure to make additional use(s) of a given accessory. Additional such other removably structure can include, for example, one or more of a strap connector or a passage-bearing connector for connection to, for example, a rope, an exercise strap such as a resistance band for example, a chain, or a carabiner.

In some systems, one or more accessories can have a mount—for example, a quick-connect dovetail mount (also known as a "2× dovetail mount" in a disclosed embodiment)—removably mountable to a mating mount—for example a mating dovetail mounts—in the central weight base or in other accessories. In some embodiments, the modular dovetail connection provides a more secure and customizable connection between fitness equipment handles, in some instances overcoming limitations of fixed connections in the prior art.

Alternatively or in addition, other removable mounting structures may be utilized, such as tubular mounting structures. Yet other mounting structure can include fixed or slidable locking pins slidably penetrable of mating passages in the given accessory and mating accessory mounting structure in the central weight base. When used in conjunction with a dovetail connection for example, in some embodiments an accessory can be quickly connected or disconnected from a central mounting or other mating structure by a pin sliding and dovetail sliding motion, which can be nearly simultaneous.

In some embodiments, at least one weight plate can be mounted within a weight plate retention pocket, cavity, or other weight plate mating mounting surface or section in the central weight base. In some embodiments, the weight plate base has a somewhat disk-shaped or circular outer periphery and one or more of various types of weight training bars or other accessories can be attached to the outer periphery to extend at least partially radially outwardly and thereby provide for use of the resulting weight training apparatus in weight training exercise by a user of resulting apparatus. In some applications, the one or more weight training bars or apparatus can be removably attached to one or more external mounting sides or side portions of the central base.

In some systems, the central weight base has one or two weight plate mounting pockets, cavities, or other weight plate mounting surfaces with an interior passage coaxial with an interior passage in one or more weight plates mountable within the one, or the opposed, weight plate mounting pockets, cavities, or weight plate mounting surface(s).

One or more of the central mounting base, bars, and/or connectors or other accessories may be made of strong and heavy metal, such as steel, stainless steel, or cast iron or other metal or metal alloy. In some embodiments, one, more, or all these components can be solid (e.g., non-tubular for example), thus increasing the weight and, in some embodiments, the strength of the components. Other materials, such as composites or plastics, may be used to provide aspects of the present exercise components and systems. For example, threading nuts for securing weight plates can be made of such other materials, such as plastic for example.

One or more components may have one or more layers of other materials laminated or other applied and secured to one or more external surfaces of the component(s). For example, one or more various components or accessories may have a foam or plastic layer mounted to one or more external surfaces. One more surfaces on one or more components may also be painted or otherwise treated, such as by anodizing or electroplating for example, to render the surface(s) more attractive (such as by colorizing for example), durable, resistant to staining or rusting, etc.

In some embodiments, the central weight mounting base has a center surrounded by system accessory side mounting section and at least two, and in some embodiments, all, among the plurality of system accessory mounts in the accessory side mounting section are equidistant from the center of the central weight mounting base. Some instances of the central weight mounting base have at least three, and in some embodiments, each adjacent pair, among the plurality of system accessory mounts in the accessory side mounting section of the central weight mounting base are equidistant from each other.

In addition, some systems employing a central weight plate and accessories disclosed herein provide at least exercises that include a arm curl, single kettlebell exercises, double kettlebell exercises (including angled handle exercises, including pushup with the opposed handles spaced from a support floor), and straight bar, EZ bar, and inverted EZ bar exercises, alternatively with 0-4 weight plates, for example, 10 lb. plates. Some embodiments support inclusion of even more, or lighter or heavier, weight plates. Some embodiments, such as when combined with a conventional barbell weight training system (such as that employs conventional weight plates have central passages penetrating the plates) and one or more connector accessories, can provide from hundreds to many more differing types of exercises.

It can thus be seen that, in some embodiments, the one or more accessories mountable to a central weight base provide users with one or more options for customizing their workout routine and targeting specific areas of the human body. Some embodiments can therefore provide from one or more of, to all of: a more versatile, customizable, compact, space-saving, economical, portable, and effective workout system and experience compared to the prior art.

In addition, some instances combining a central weight base with single or double handle kettlebell-like structure offer greater convenience and versatility, with adjustable weight increments that can, in some embodiments, eliminate the need for multiple kettlebells of varying weights.

There are many other novel features and aspects of the present specification and mixing and matching of the many various such features and aspects. They will become apparent as the specification proceeds.

It is to be understood, however, that the scope of the present invention is not to be determined by whether it includes a feature or aspect because it is addressed in the above Brief Background or in this Brief Summary section. The scope of the invention is rather to be determined by the claims as issued based on this specification.

BRIEF DESCRIPTION OF THE DRAWINGS

The inventor's preferred and other embodiments are disclosed in association with the accompanying drawings in which.

DETAILED DESCRIPTION

Figure 1:
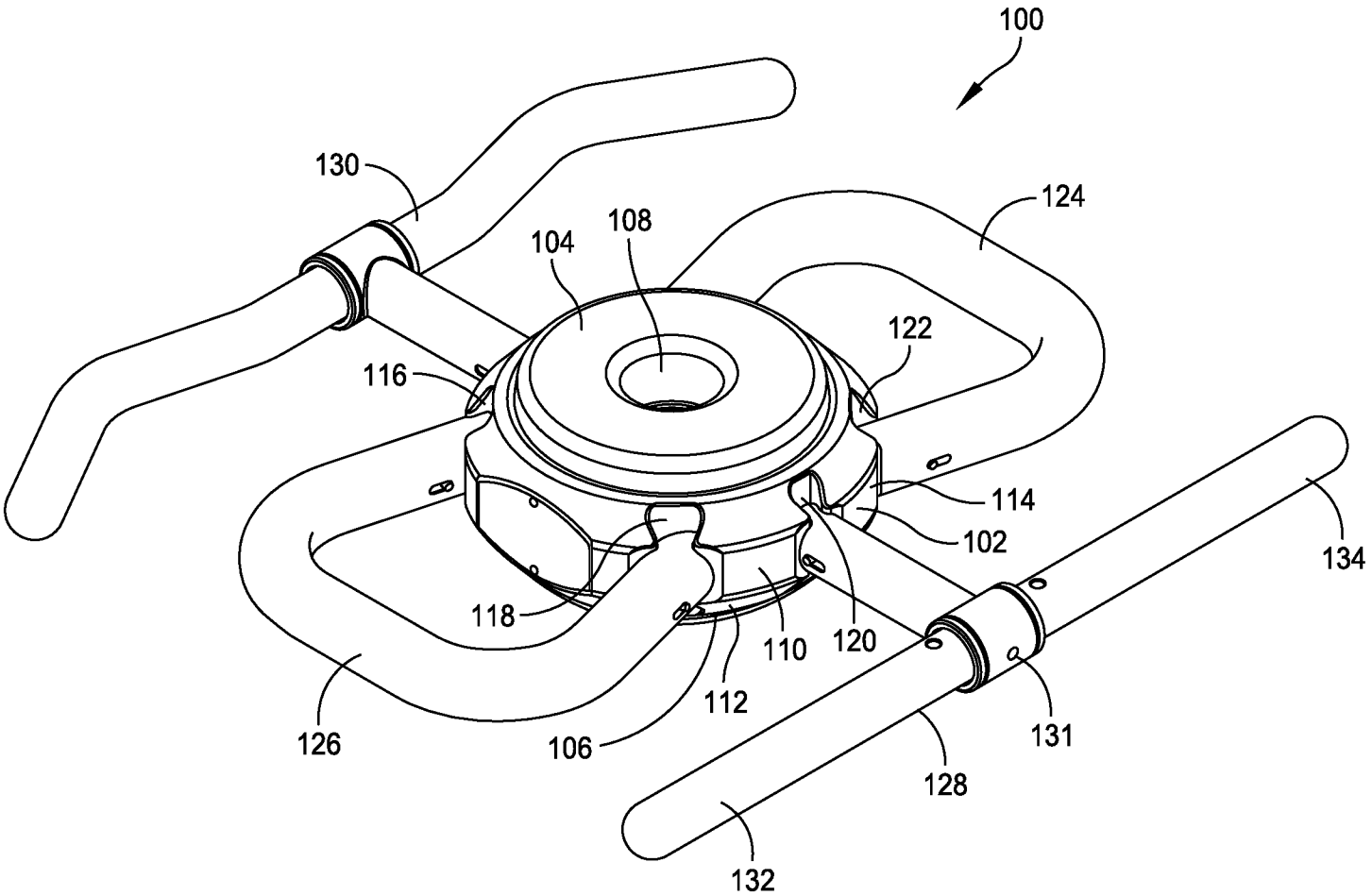
FIG. 1 is a perspective view of an assembled XPLATE™ exercise apparatus embodiment, having a central weight plate mounting base and, extending outwardly from the weight plate mounting section, opposed U-shaped handles and opposed T-shaped bar and EZ bar intermediate the opposed U-shaped handles.

With reference to FIG. 1, an assembled XPLATE™ exercise apparatus embodiment, generally 100, has a central, somewhat disk-shaped weight plate mounting base 102 in which one or more weight plates, e.g., 104, 106, may be mounted. One or more of the weight plates, e.g., 104, may be of the type that is disk-shaped and, optionally, with a central weight-mounting-bar mounting passage 108. In some embodiments, this type of passage 108 can allow the weight plate, e.g., 104, to be alternatively mounted to (not shown in FIG. 1) a conventional or other dumbbell bar or to another type of weight mounting bar such as a conventional longer weight lifting or EZ-curling bar for example.

In the exemplary embodiment of FIG. 1, the central weight plate mounting base 102 has two opposed somewhat disk-like surface portions 110, 112, with an outer peripheral, side 114 extending between the two disk-like surface portions 110, 112. Six accessory mounting slots, e.g., 116, 118, 120, 122, penetrate the outer peripheral side 114 extending between the two opposed somewhat disk-like surface portions 110, 112.

Two opposed U-shaped handles 124, 126 extend radially outwardly from outer peripheral side 114 of the central mounting base 102. Intermediate the two opposed U-shaped handles 124, 126, a T-shaped lifting bar structure 128 and EZ bar 130 extend radially outwardly opposite each other from the outer peripheral side 114 of the central mounting base 102. In this regard, some embodiments of the EZ bar can be rotated 180 degrees by loosening and tightening its interconnection section 131.

Thus, a variety of differing exercises can be performed with this single exercise apparatus embodiment 100. Examples of such exercises include:

- a military press by gripping the opposed U-shaped handles 124, 126 with two hands (not shown), with one hand on one U-shaped handle 124 and another hand on the opposed U-shaped handle 126;
- a bicep arm curl or tricep extension by gripping with two hands either the T-shaped lifting bar 128 or the EZ bar 130;
- a military press by gripping the T-shaped lifting bar 128 with two hands gripping opposed lifting or pressing end sections 132, 134 of the lifting bar 128; and
- a torso-bent-over rowing or lifting exercise by gripping the opposed U-shaped handles 124, 126 with two hands.

As explained above and below as this specification proceeds, a great many other types of accessories may be mounted to the central mounting base 102 and, in addition, to the accessories. Thus, a great many other types of exercises may be performed with the embodiment of FIG. 1 and with yet such other structures and accessories disclosed herein.

Figure 2:
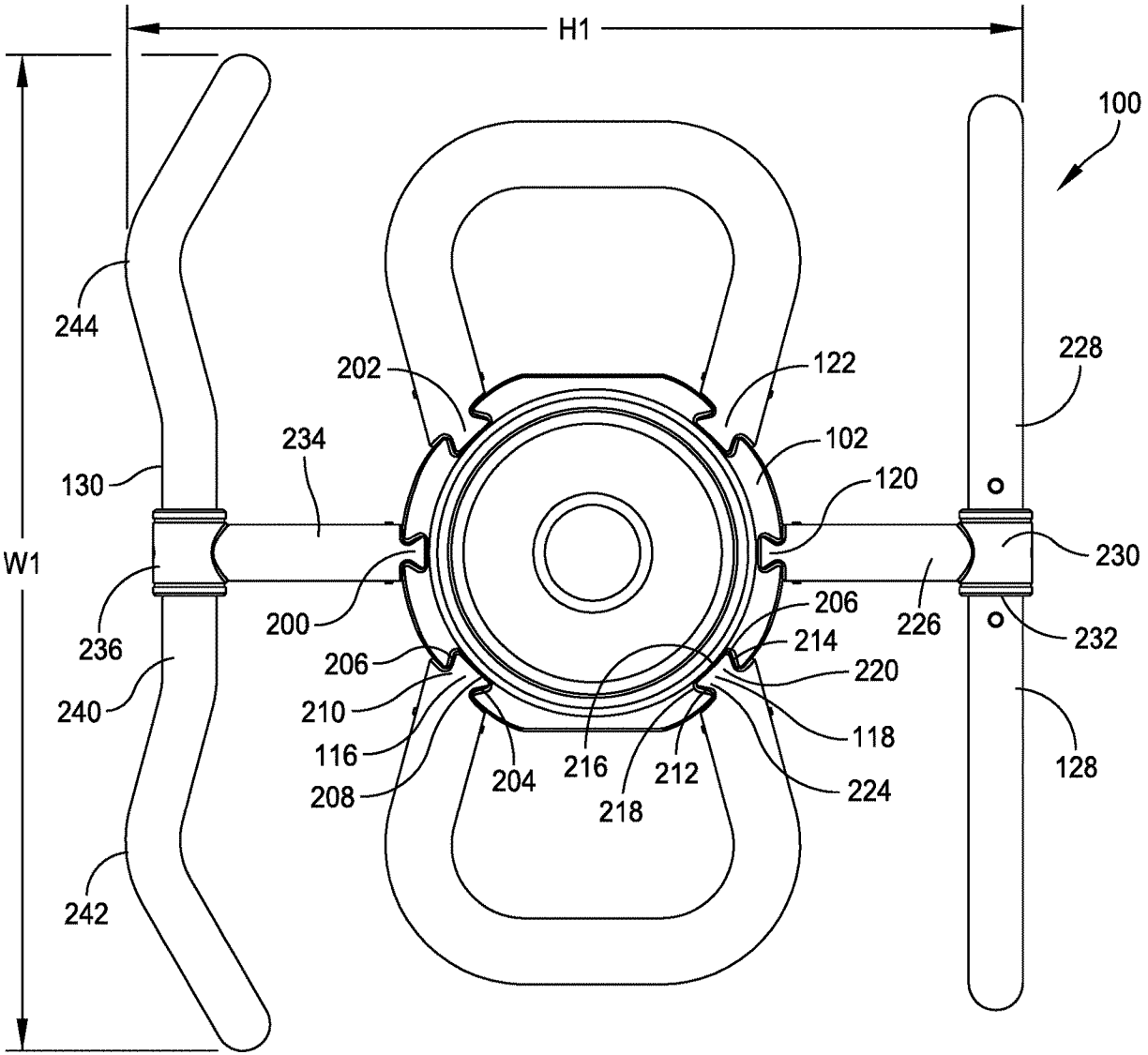
FIG. 2 is a plan view of the assembled exercise apparatus embodiment of FIG. 1.

With reference now to FIG. 2, each accessory mounting slot, e.g., 202, is a female dovetail channel with opposed channel sidewalls 204, 206, extending at an inwardly acute angle from the channel base section 208 interconnecting the channel sidewalls 204, 206. The channel mouth or opening 210 is thus narrower than the width of channel base section 208 as measured from channel sidewall 204 to the opposed channel sidewall 206.

Each accessory mount, e.g., 210, is a male dovetail having opposed male sidewalls 212, 214, extending between a male dovetail locking wall 216. The male dovetail 210 is thereby slidably and matingly mounted within, and to abut, the interior channel sidewalls 218, 220, and channel base section 222 of the mating female dovetail channel 224.

With regard to the T-shaped lifting bar 128, it has a linear base mounting bar 226 along with a linear or laterally extending lifting bar 228 extending tranversely to the base mounting bar 226 from within a lifting bar mounting tube 230 secured to the lifting-bar-mounting end 232 of the linear base mounting bar 226.

With regard to the opposed EZ bar 130, it also has a linear base mounting bar 234 with an EZ bar mounting tube 236 secured to the EZ bar mounting end 238 of the linear base mounting bar 234. A central rod section 240 of the EZ bar 130 is mounted within and securely gripped by the EZ bar mounting tube 236 so that the central rod section 240 is transverse to the linear base mounting bar 234. Extending from the central rod section 240 are opposed EZ-bar bent or slightly V-shaped sections 242, 244.

An exemplary width W1 of the exercise apparatus 100 can be from 10 to 60 inches, for example 20.65 inches. An exemplary height H1 of the exercise apparatus 501 can be from 9 to 60 inches, for example 18.3 inches. The entire FIG. 2 embodiment less the weight plates, e.g., 104, 106, weights in the range of 20-100 lbs. When the central weight base 102 is made of ductile iron and the depicted accessories, 124, 126, 130, 132 are made of cold rolled steel, the entire FIG. 2 embodiment less the weight plates, e.g., 104, 106, is 45-47 lbs., such as 46 lbs. for example.

Figure 3:
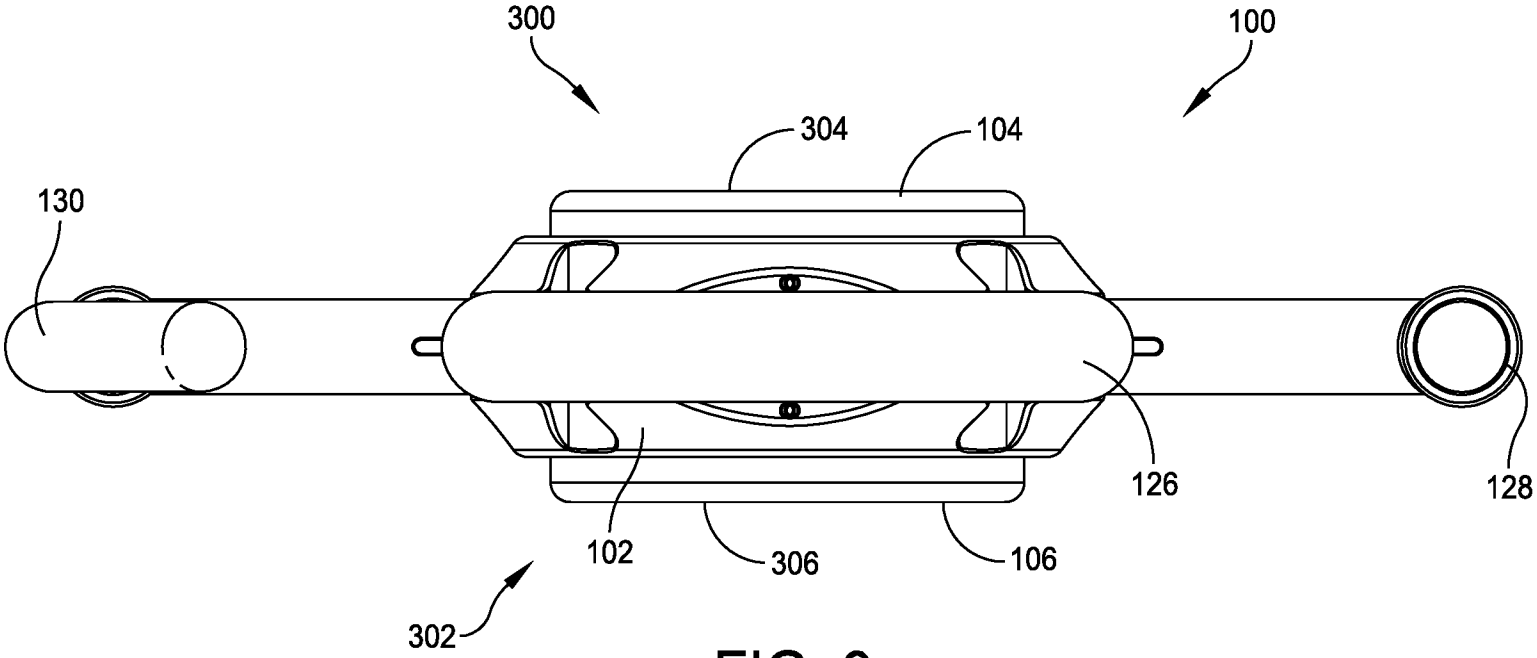
FIG. 3 is a left side elevational view of the assembled exercise apparatus embodiment of FIG. 1.
Figure 4:
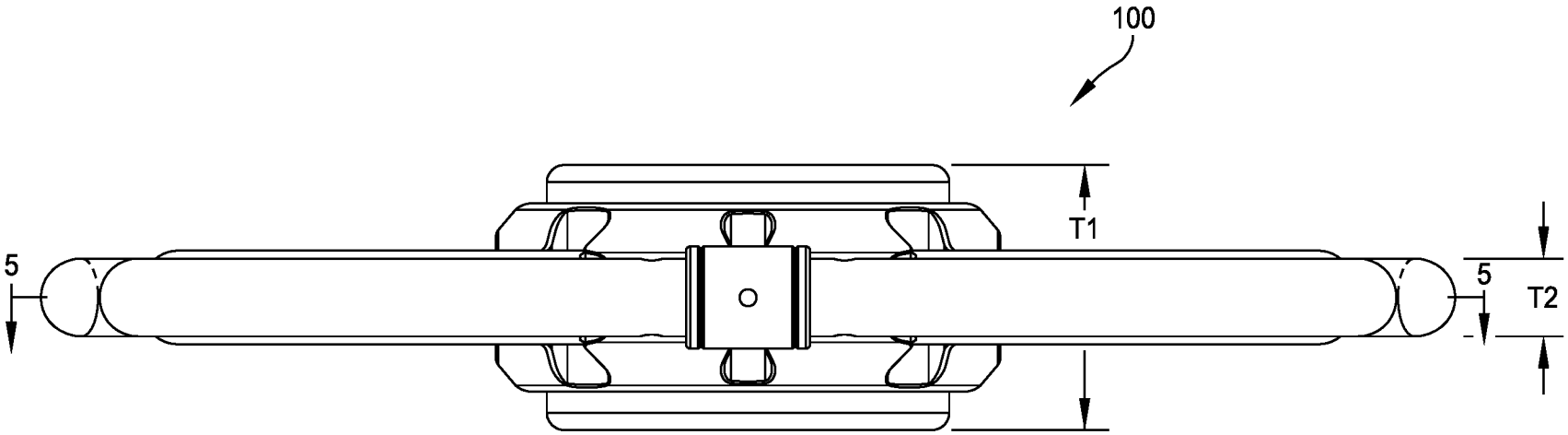
FIG. 4 is front side elevational view of the assembled exercise apparatus embodiment of FIG. 1.

Turning now to FIG. 3, the opposed weight plates, e.g., 104, 106, are mounted in the opposed sides, generally 300, 302, of the weight plate mounting base 102. The weight plates 104, 106 may have generally planar opposed external sides, 304, 306, respectively, thus allowing the exercise apparatus 100 to rest against opposed surfaces, such as wall, floors, or other structure (not shown), in an unobtrusive manner. Similarly, the various accessories 130, 126, 134, can, in some embodiments, extend outwardly from the mounting base 102 intermediate the weight plate external sides 304, 306, also providing that the exercise apparatus 100 may rest against, or be mounted to, a supporting or mounting structure in an unobtrusive and space saving manner, such as along the floor, a sidewall, or wall mount for example. Further, this unobtrusive structure 100 can be manipulated during exercise with less thick structure, or other protruding components, that otherwise possibly collide with, or catch on, clothing or the skin of a user, as can happen with thicker kettleballs for example. in Referring now to FIG. 4, exemplary maximum thickness, T1, of the exercise apparatus may be from 2.5 to 15 inches, for example 5 inches. Exemplary weight bar or handle accessory maximum thickness may be from 0.7 to 3 inches, for example 1 inches.

Figure 5:
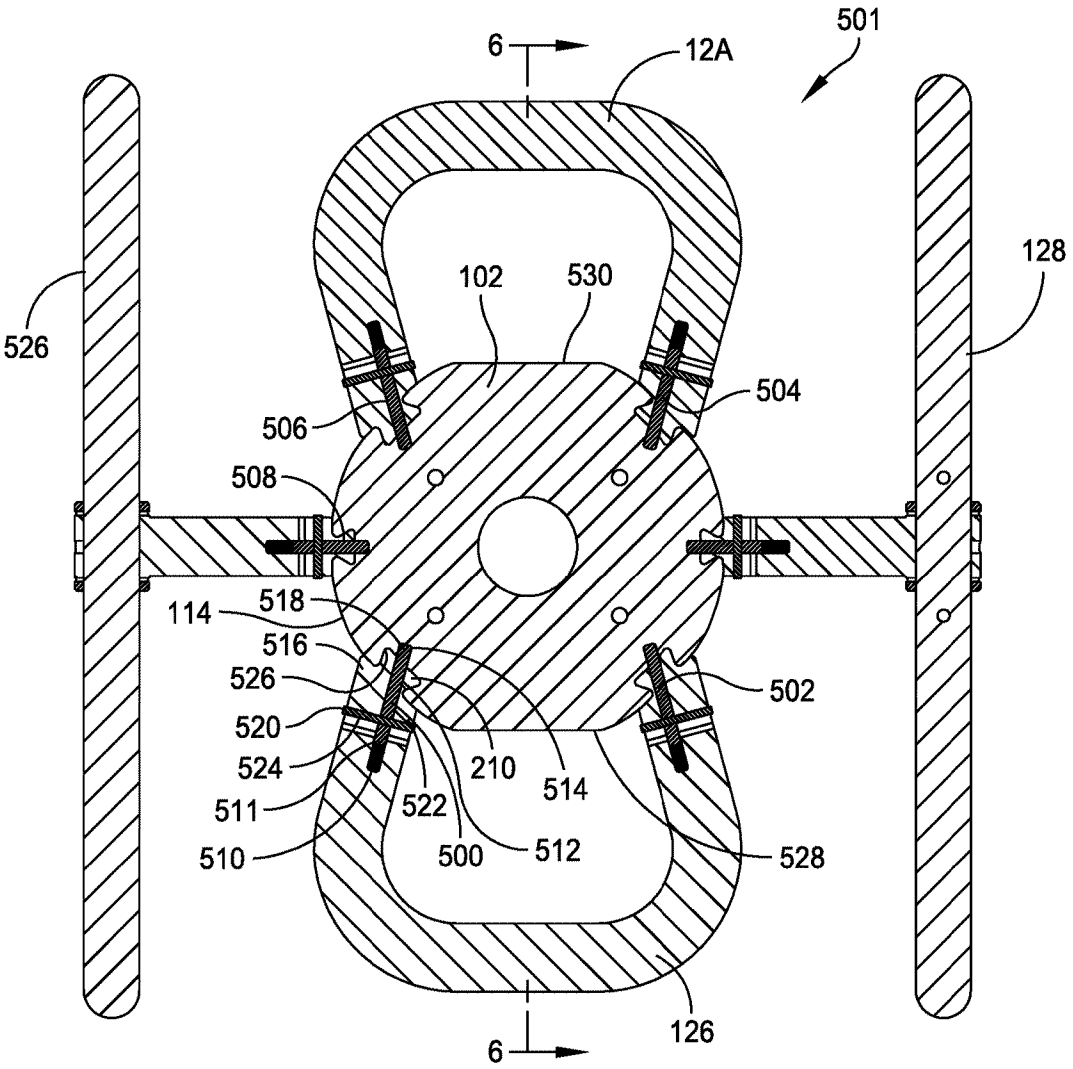
FIG. 5 is a cross-sectional view of the assembled exercise apparatus embodiment of FIG. 1 (but with a T-shaped bar substituted for the EZ bar of FIG. 1) taken along section line 5-5 of FIG. 4.

With reference to FIG. 5, the exercise apparatus, generally 501, can include slidable accessory locking pins, 500, 502, 504, 506, 508, 510. Each locking pin, e.g., 500, can be slid in mating co-axial passages 511, 512, 514 extending from an accessory section 516, through an accessory male dovetail 210, and into the pin receiving passage 518 penetrating the outer peripheral side 114 in the central mounting base 120. The pin-sliding action can be achieved with opposed fingers in a hand (not shown) gripping and sliding exposed, opposed ends 520, 522 of an activation pin 524 penetrating a activation pin passage (not shown) transverse to the axis of the locking pin 500. With the locking pin, e.g, 500, fully penetrating the pin receiving passage 518, the slidable male dovetail 210 is prevented from sliding, and is locked in place, within the mating female dovetail channel 526.

In the exercise apparatus 501 of FIG. 5, a second T-shaped lifting bar 526 is substituted for the EZ bar of the FIG. 1 embodiment. All components of the exercise apparatus 501 of FIG. 5, or of the exercise apparatus 100 of FIG. 1, may be made of durable and recyclable or other metal as desired. For example, with regard to FIG. 5, the central mounting base 102, the bodies of the opposed U-shaped handles 124, 126, and the main bar components of opposed T-shaped bars 128, 502, and, with regard to FIG. 1, the EZ bar 130 may be made entirely of, or variously of, recyclable, strong, and long lasting cast iron or steel, and/or other metal as desired. Referring back to FIG. 5, certain components, such as the locking pins, e.g., 500, and activation pins, e.g., 524, may be made of steel or other strong, long lasting material and may have external film or other material added to increase ease of slidability.

With continuing reference to FIG. 5, the central mounting base 102 may have one more flattened planar sections such as opposed flattened sections 528, 530 in the outer peripheral side 114 of the central mounting base 102. In certain applications, such as with only one or two U-shaped accessories, e.g., 124, 126, mounted to the central mounting base 102, these flattened sections, e.g., 528, 530, can allow greater area for a user's hand, wrist, or lower arm to fit and move without interference in the area confined by, for example, a U-shaped accessory, e.g., 124, and the adjacent flattened section 530.

Figure 6:
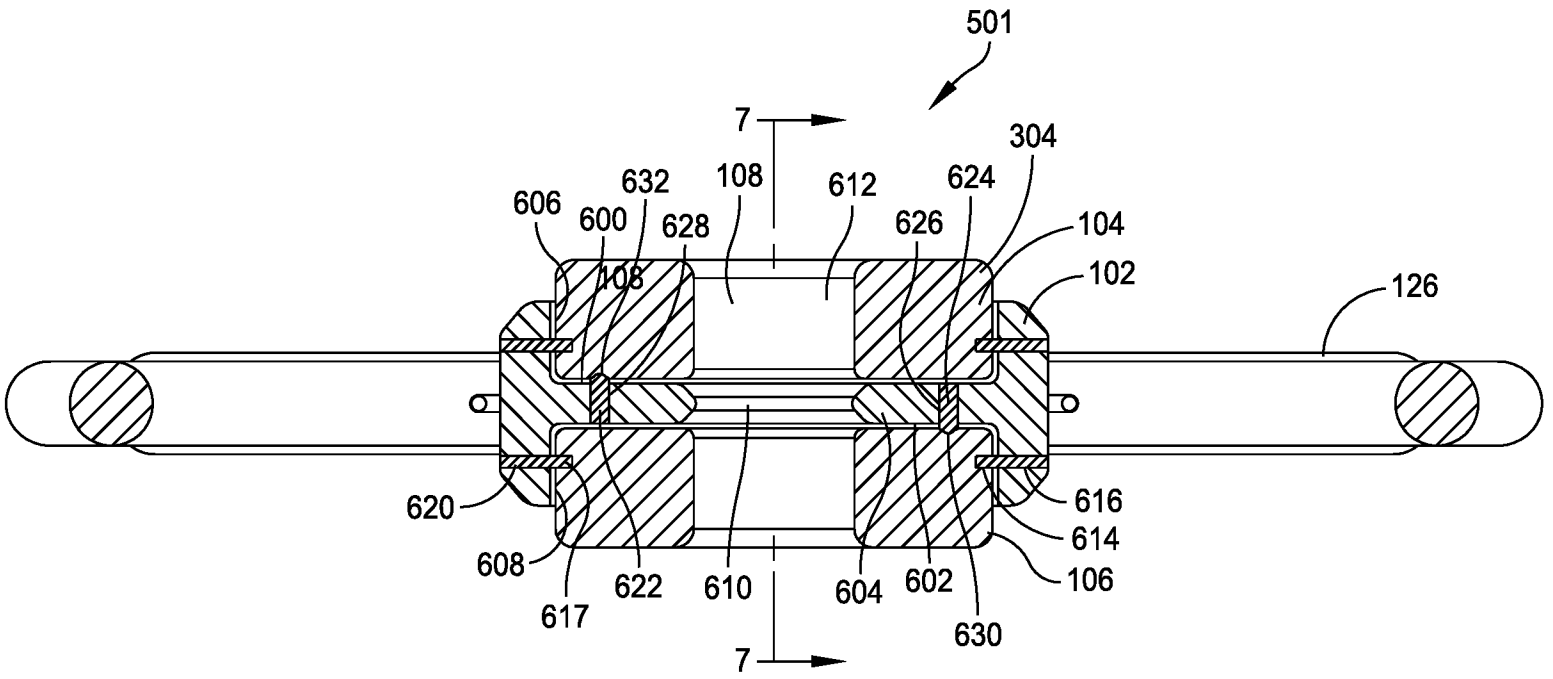
FIG. 6 is cross-sectional view of the assembled exercise apparatus embodiment of FIG. 1 taken along section line 6-6 of FIG. 5.

With reference now to FIG. 6, the central plate mounting base 102 has the first weight plate 104 removably mounted within a first plate mounting cup or cavity 600 and the opposed second weight plate 106 removably mounted within an opposing second plate mounting cup or cavity 602. The first and second weight plates 104, 106 are spaced from each other by a shared mounting cup base 604 having parallel opposed planar cavity sides 600, 602 extending between and interconnecting the first mounting cup circular sidewall 606 and extending between and interconnecting the opposed second mounting cup circular sidewall 608.

A central mounting cup base passage 610 is coaxial with central mounting passage 108 in the opposed first and second weight plates 104, 106. The central mounting cup base passage 610 and central mounting passage 108 thereby cooperatively provide a central exercise apparatus passage 612 extending fully from external side 304 of the first weight plate 104 to the opposed external side 306 of the second weight plate 106. The central exercise apparatus passage 612 may be used for variety of purposes, including to mount the exercise apparatus on a wall or other structure peg or hook (not shown) for example. Alternatively, the central plate mounting base 102 and one or more of the weight plates, e.g., 104, may have no, or a narrower or wider, central exercise apparatus passage 612 or passage sections or passage depressions formed in one or more of a weight plate's opposed sides.

The first mounting cup circular sidewall 606 and second mounting cup circular sidewall 608 can have pressed or threaded plate locking pins, e.g., 614, penetrating matingly threaded or otherwise aligned coaxial plate locking pin passages, e.g., 616, 617, extending radially inwardly (toward the axis of the central exercise apparatus passage 612) through mounting cup circular sidewalls, e.g., 606, to penetrate the outer circumferential sides, e.g, 618, of each of the first and second weight plates, e.g., 104. In the embodiment of FIG. 6, there are two opposed plate locking pins (such set screws), e.g., 614, 620, threaded into each of the opposed weight plates 104, 106 after the plate, e.g., 104, is mounted into its associated central weight base cup, e.g., 600, by a user or other entity. Other quantities of plate locking pins may be used per weight plate, e.g., 104, such one to four such locking pins, and in the case of three or more such pins, they may be spaced in differing ways around the weight plate outer circumferential sides, e.g., 104.

While the locking pins, e.g., 614, 620, help secure the weight plates, e.g., 106, within the central plate mounting base 102, spring loaded ball-nose spring plungers, e.g., 622, 624, penetrate the shared cup base 604 in the central plate mounting base 102. The spring plungers, e.g., 622, 624, are press fit into mating plunger passages, e.g., 626, 628, in the cub base 604 so that plunger spring loaded ball-noses, e.g., 630, 632, extending from the plungers, e.g., 622, 624, abut and urge the mating weight plates, e.g., 104, 106, away from cub base 604 and thereby forcing interlocking engagement of the locking pins, e.g., 614, 620, in their mating locking pin passages, e.g., 616, 617, in the weight plates, e.g, 104, 106. In addition, the spring-loaded plunger(s) can also provide shock absorption when the associated weight plate in contact with the plunger(s) makes contact with another structure or a user, reducing impact of the weight plate on such structure or user. An exemplary ball nose plungers, e.g, 622, is McMaster-Carr™ part number 84835A24.

An optional weight plate mounting structure can provide at least one plate mounting threaded section on a side of the weight plate. The plate mounting threaded section can in turn be threadable to matingly threaded section in the central weight mounting base and/or in an exposed side of an adjacent weight plate when mounted, which can, in some embodiments, be threadable mounting, to the central weight mounting base.

Figure 7:
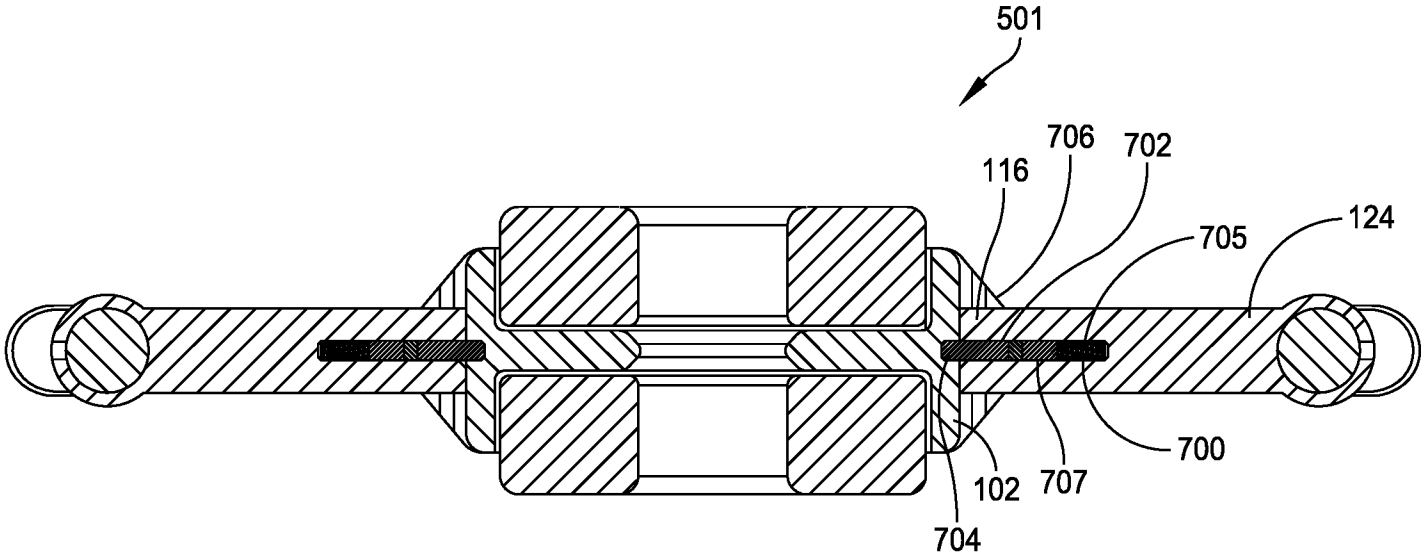
FIG. 7 is cross-sectional view of the assembled exercise apparatus embodiment of FIG. 1 taken along section line 7-7 of FIG. 6.

With reference now to FIG. 7, accessory locking pin passages, e.g., 700, are axially longer than a mating accessory locking pins, e.g., 702, mounted in the mating accessory locking pin passages, e.g., 700. The accessory locking pins, e.g., 702, are biased toward the base penetrating portions, e.g., 704, of the accessory locking pin passages, e.g., 703, by accessory mounting springs, e.g., 705, mounted within accessary penetrating portions, e.g., 70, of the accessory locking pin passages, e.g., 700. The locking pins, e.g., 702, can thereby be (as further described in association with FIG. 8 below) manually slid out of the mating base penetrating portion 704 of the accessory locking pin passage, e.g., 703, in the central plate mounting base 102. The apparatus accessory, e.g., U-shaped bar 124, may then be demounted from (slid out of) the central plate mounting base 102 by first sliding all such locking pins, e.g., 702, extending from the accessory, e.g., 124, out of the mating base penetrating portion, e.g., 704, of the accessory locking pin passages, e.g., 700, in the central plate mounting base 102.

Conversely, an apparatus accessory, e.g., U-shaped bar 124, may then be mounted to (slid into) the central plate mounting base 102 by first manually sliding all such locking pins, e.g., 702, extending from the accessory, e.g., 124, to fully penetrate the accessory penetrating portion, e.g., 704, of the accessory locking pin passages, e.g., 700, in the central plate mounting base 102. After the accessory male dovetail 116 is slid fully into the mating female dovetail 706, the user can manually releasing the locking pins, e.g., 702, to allow the accessory locking pins, e.g., 702, to penetrate the base penetrating portions, e.g., 704, of the accessory locking pin passages, e.g., 703, thereby interlocking the male dovetail 116 in position in the female dovetail 706 and securing the mounting of the accessory, e.g., 124, to the central weight plate base 102. (See also FIGS. 28-32 and associated text below.)

Figure 8:
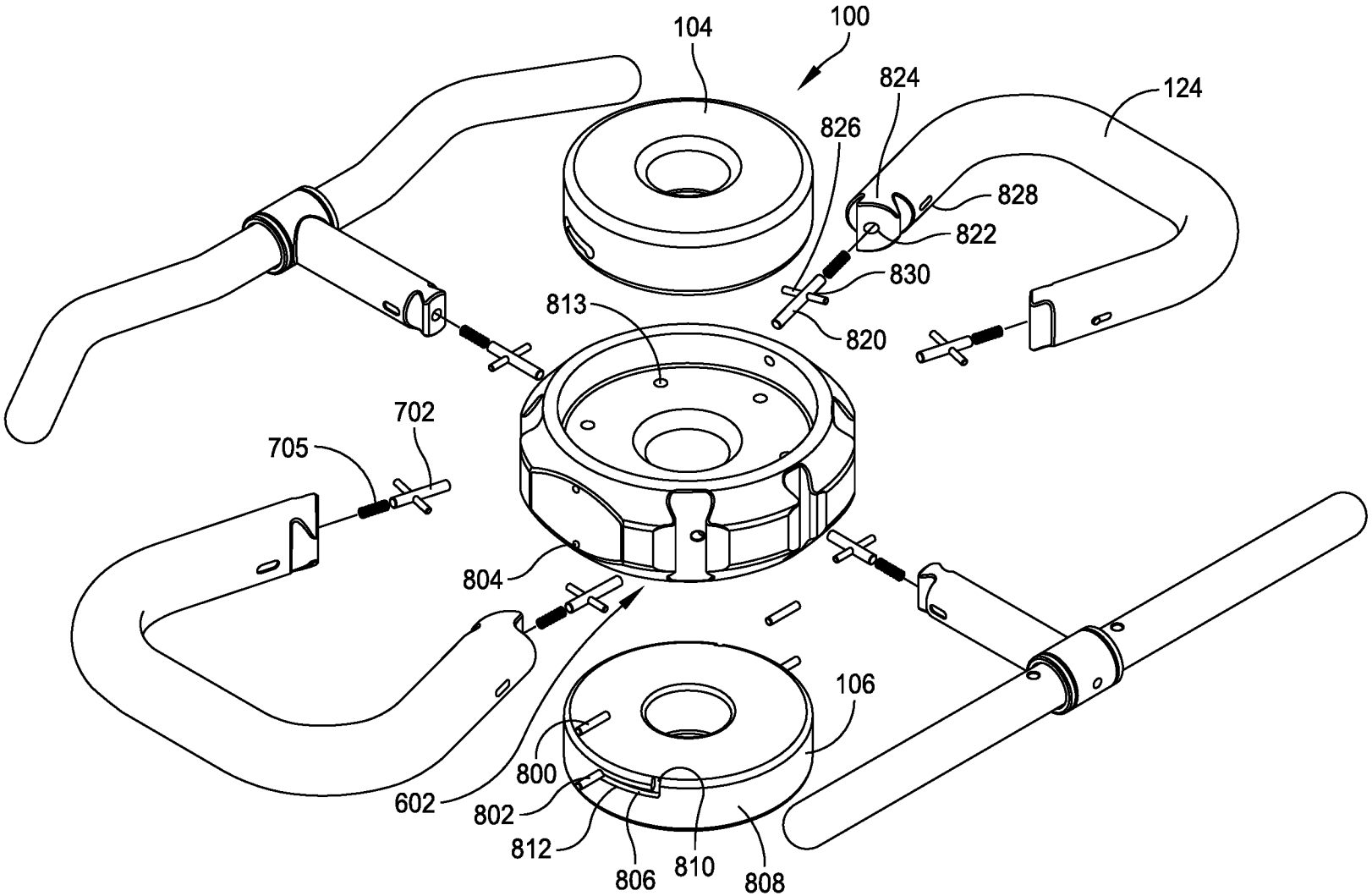
FIG. 8 is an exploded view of the exercise apparatus embodiment of FIG. 1.

Referring now to FIG. 8, in this embodiment 100, each weight plate, e.g., 106, is mounted to, and held in, position in the central plate mounting base 102 by opposed plate locking pins 802, 802, pressed into opposed plate locking pin passages, e.g., 804, penetrating the central plate mounting base 102 to penetrate mating L-shaped locking pin slots, e.g., 806, in the outer peripheral sides, e.g., 808, of the weight plates, e.g., 106. Weight plates, e.g., 106, can thus be mounted within mating plate mounting cups, e.g., 602, by manually aligning a plate locking pin, e.g., 804, with a plate locking pin opening, e.g., 810, pressing the plate locking pin, e.g., 804, into the plate locking pin opening, e.g., 810, and then penetrating a plate locking slot portion, e.g., 812, transverse to the plate locking pin opening, e.g., 810, and pressing the weight plate, e.g., 106, to compress mating opposing spring plungers, e.g., 813, and twisting the weight plate, e.g., 106, to slide the plate locking pin, 802, to further penetrate the plate locking slot, e.g., 812, along its length distal from the plate locking pin opening 810.

Conversely, the weight plates, e.g., 106, can be removed from the central plate base 102 by reversing the weight plate mounting process of mounting described above.

With continuing reference to FIG. 8, as similarly noted above the accessory locking pins, e.g., 820, are slidably mounted within mating accessory locking pin passages, e.g., 822, in mounting sections, e.g., 824, of accessories, e.g., 124. Each accessory locking pin, e.g., 820, also includes a transverse gripping pin 826 pressed into gripping pin slots, e.g., 828, in the associated accessory 124 and, within the interior of an associated locking pin passage, e.g., 822, through a mating gripping pin passage 830 in the accessory locking pin 820. Each accessory locking pin, e.g., 820, can therefore be slid within the locking pin passage, e.g., 822, by gripping opposed ends of the gripping pin 826 extending within and slightly externally of the gripping pin passage 830.

Figure 9:
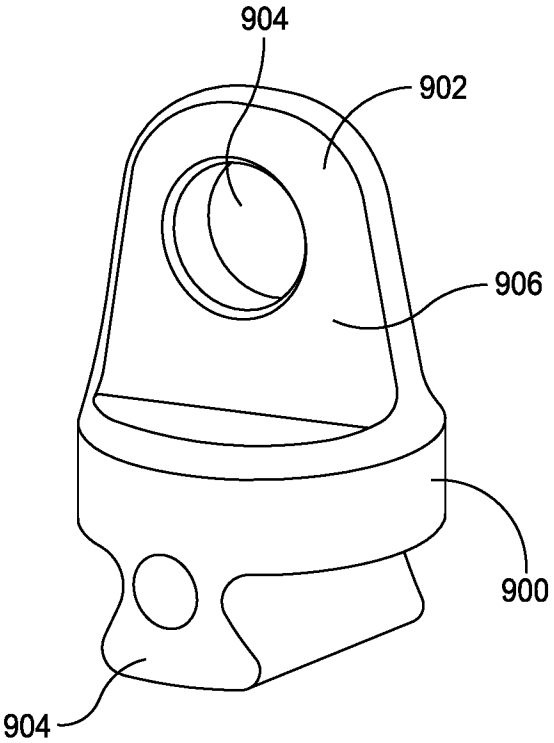
FIG. 9 is a connector accessory with a male dovetail mount slidably mountable in a mating female dovetail mount penetrating the side periphery of the central weight plate mounting base of the exercise apparatus embodiment of FIG. 8.

With reference now to FIG. 9, a connector accessory 900 can have a connector end 902 opposite a dovetail mount end 904. An exemplary means for connecting in the connector 900 can be a device connecting passage 904 in a narrowed section 906 in the connector end 902. Thus, the connector accessory 900 can be mounted to a central plate mounting base (not shown in FIG. 9) in a fashion such as described above with respect other accessories (not shown in FIG. 9). In turn, one or more other devices may be connected to the connector accessory 900 and thereby utilize in connection with the associated central mounting base.

Figure 10:
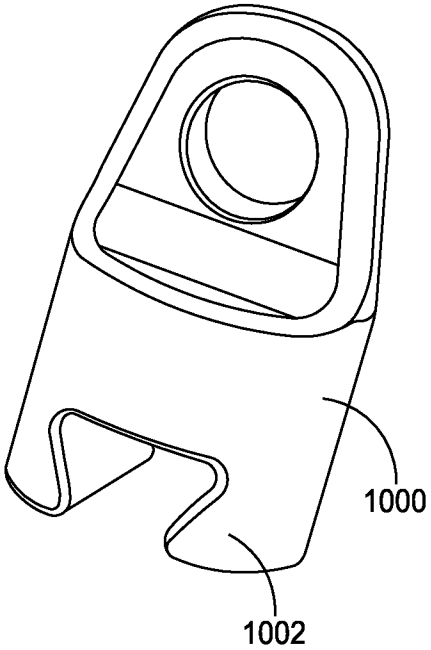
FIG. 10 is an alternative connector accessory with an alternative female dovetail mount slidably mountable in an alternative male dovetail mount (not shown) in an alternative central weight plate mounting base (not shown)

Referring to FIG. 10, a connector accessory 1000, for example can alternatively have a female dovetail 1002 at its mounting end 1004 for mounting to an alterative male dovetail (not shown) rather than a female dovetail on the central plate mounting base. Further, the female dovetail 1002 can be mounted within a male dovetail on another accessory to render the interlinked accessories useable for purposes other than mounting to central plate mounting base.

Figure 11:
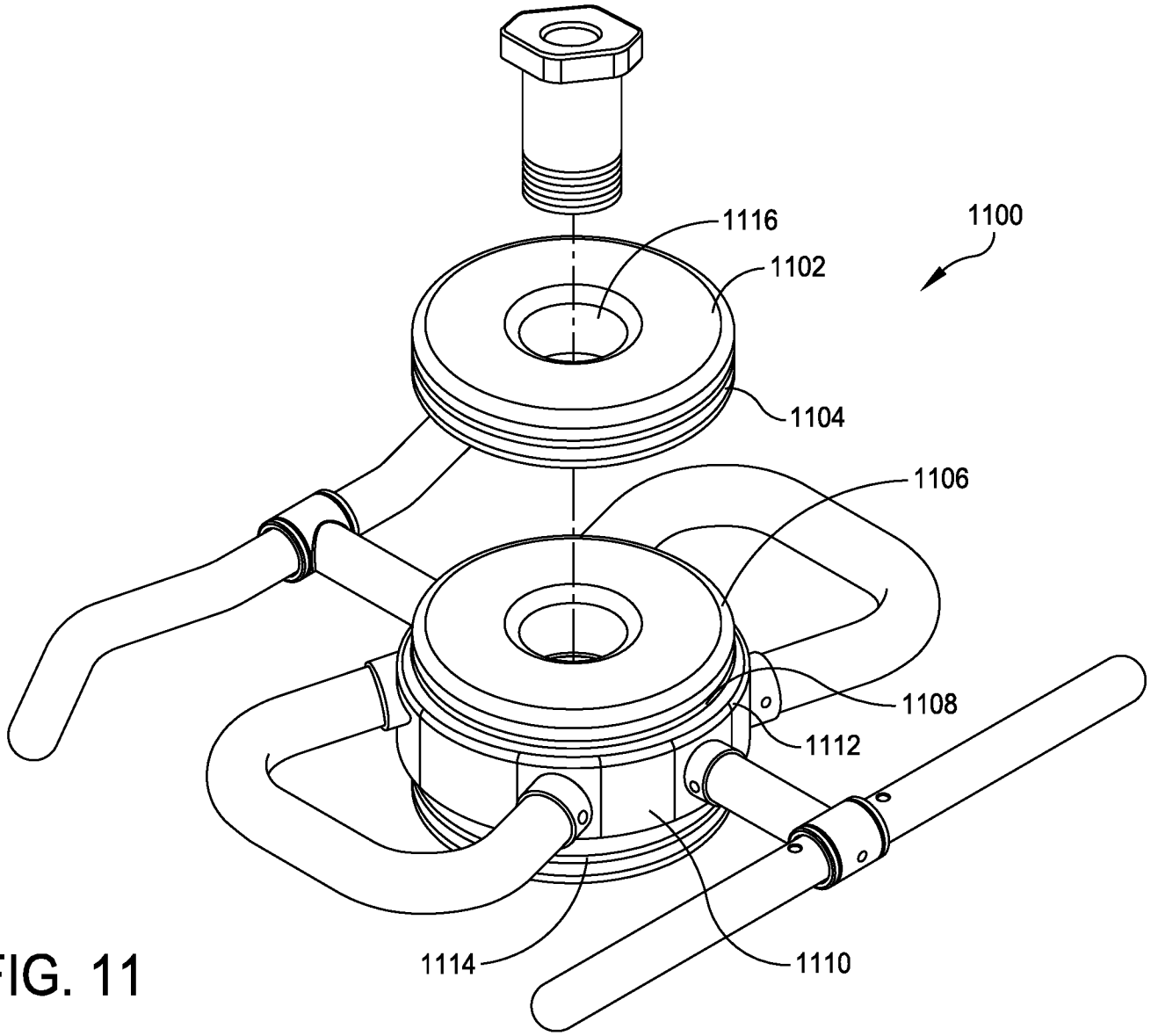
FIG. 11 is a perspective, partially-exploded view of a third, partially-assembled exercise apparatus embodiment, having a central weight plate mounting base in which two weight plates are mountable to each top and bottom side of the central weight plate mounting base by a threaded bolt penetrating central bolt passages in the weight plates and threaded into a mating female threaded section within or penetrating the opposing, bottom side of the central weight plate mounting base.

With reference to FIG. 11, an alternative exercise apparatus, generally 1100, can provide for mounting more weight plates, such as a total of eight weight plates, e.g., 1102, 1104, 1106, 1108, with four such plates 1102, 1104, 1106, 1108 removably mounted on each of the opposed base sides 1112, 1114 to an alternative central weight plate base 1110. The weight plates, e.g., 1102, may be conventional (i.e., prior art) or other weight plates having central plate mounting passages, e.g., 1116, through which weight lifting bars may be alternatively mounted (not shown).

Figure 12:
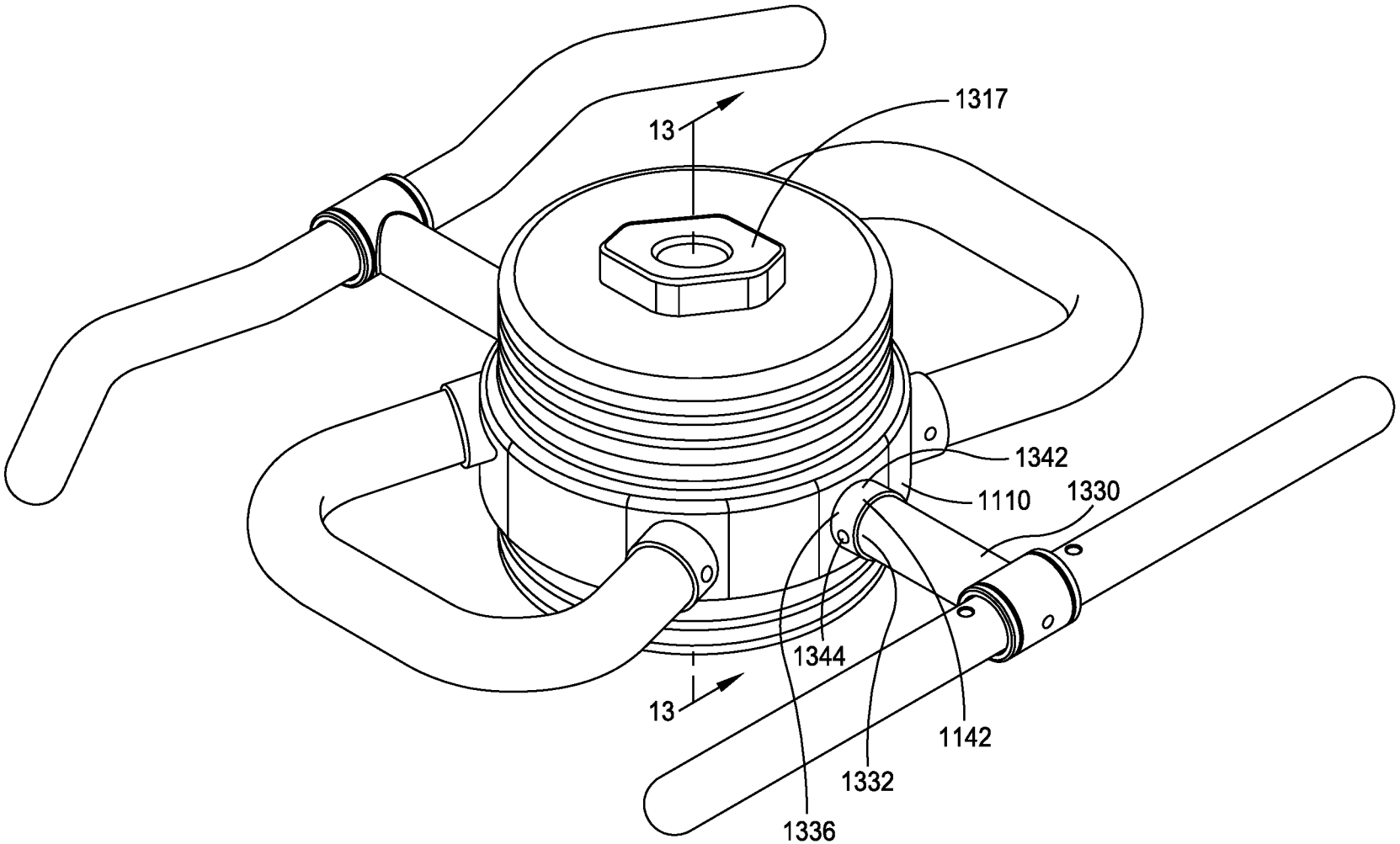
FIG. 12 is a perspective view of the third exercise apparatus embodiment of FIG. 11 but with the four weight plates secured in position with respect to the central weight plate mounting base by two threaded bolts (only the top side mounting bolt shown in FIG. 12)
Figure 13:
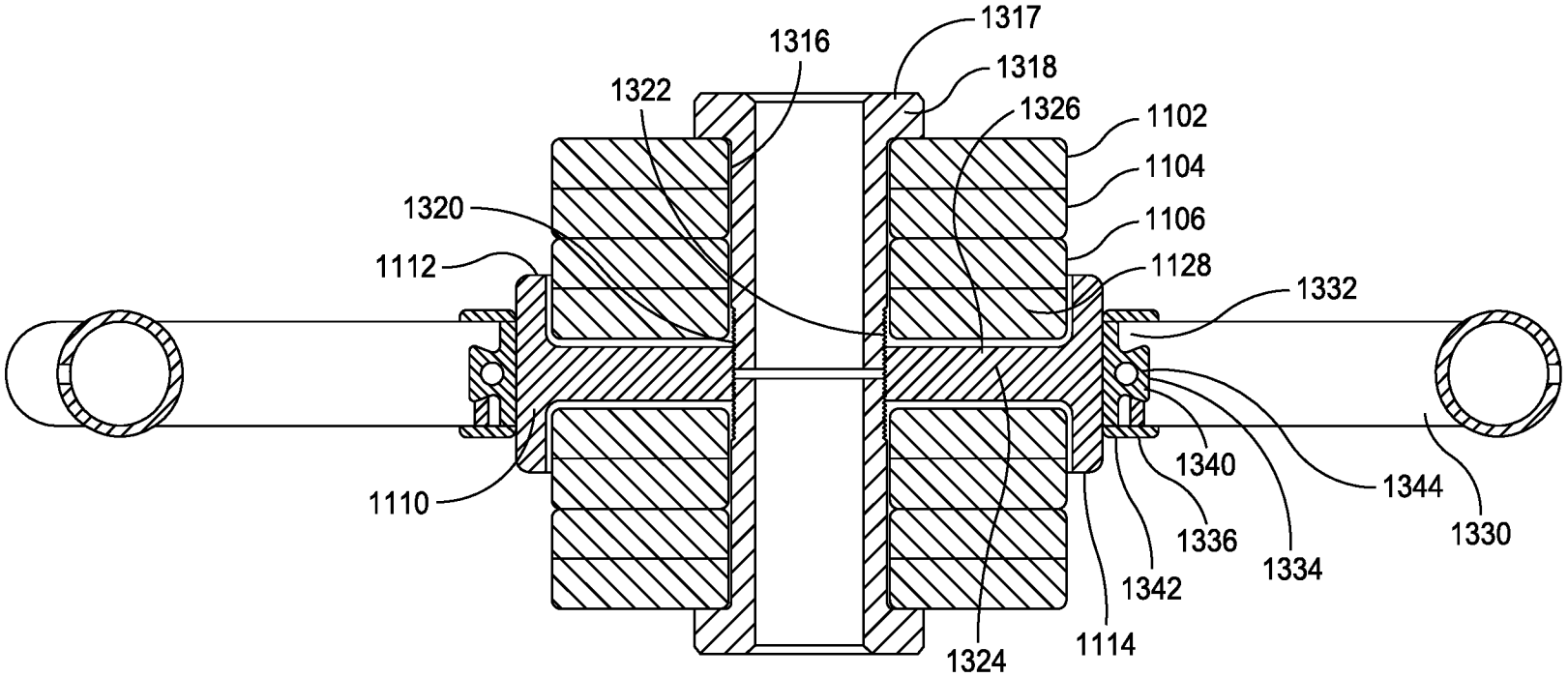
FIG. 13 is cross-sectional view of the third exercise apparatus embodiment taken along section line 13-13 of FIG. 12.

With reference to FIGS. 12 and 13, the weight plates, e.g., 1102, 1104, 1106 and 1108, are secured in position in the central plate mounting base 1110 by a threaded bolt 1318 passing through the central mount passages, e.g., 1316, to, by twisting the bolt cap 1117, lockingly thread the threaded bolt end 1120 in mating opposed threads in a threaded passage 1322 adjacent the bottom end 1324 in a plate mounting cup 1326 in the central plate mounting base 1110. Each lockingly threaded bolt, e.g., 1318, thereby secures the associated mounted weight plates, e.g., 1102, 1104, 1106, in a secure exercise apparatus use position within, and otherwise with respect to, the plate mounting cup 1326 in the central plate mounting base 1110.

In addition, the exercise apparatus accessories, e.g., 1330, have one or more tubular mounting ends, e.g., 1332, each of which with a partial female dovetail, e.g., 1334, mounted within a tubular accessory mount 1336 secured to, and radially outwardly extending from, the external side 1138 of the central plate mounting base 1110. The tubular accessory mounts, e.g., 1336, have a male dovetail 1340 matingly abutting the partial female dovetail, e.g., 1334, in the exercise accessory tubular end, e.g., 1332. In addition, the accessory mounts, e.g., 1336, also have a tubular external side 1342 surrounding the male dovetail 1340, and the tubular external side 1342 in turn matingly surrounds the tubular mounting end, e.g., 1332, of an exercise apparatus accessory, e.g., 1330. An accessory mounting pin 1344 is pressed through mating passages in the tubular external side 1342 and male dovetail 1340 to lock the accessory, e.g., 1330, in position with respect to the central plate mounting base 1110.

Figure 14:
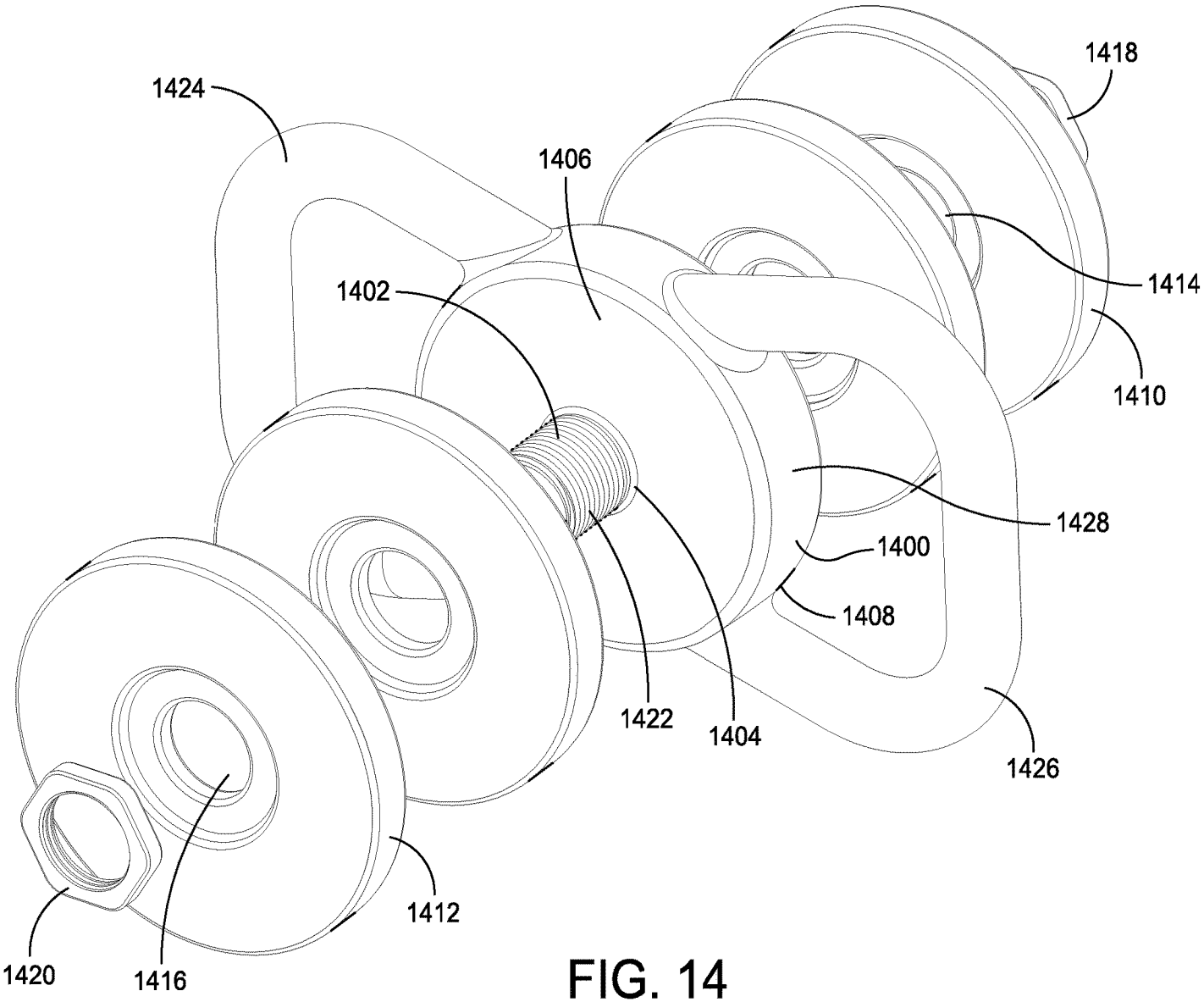
FIG. 14 is an exploded perspective view of a fourth exercise apparatus embodiment having four conventional weight plates mounted to its central weight plate mounting base via a threaded four-plate mounting rod passing through co-aligned passages in the weight plates and central weight plate mounting base.

Referring now to FIG. 14, yet another exercise apparatus embodiment can have a central plate mounting base 1400 with a prior art or other weight mounting bar 1402 penetrating a central mounting bar passage 1404 in passing from one side 1406 to the opposing side 1408 of central plate mounting base 1400. Conventional or other exercise weight plates, e.g., 1410, 1412, having central axially-extending mounting bar passages, e.g., 1414, 1416, can be mounted so that the weight mounting bar 1402 penetrates the weight plates, e.g., 1410, 1412, and opposed threaded locking nuts, e.g., 1418, 1420, can then be, as shown in FIG. 15, threaded to the opposed matingly threaded ends, e.g., 1422, of the weight mounting bar 1402 to lock the weight plates, e.g, 1410, 1410, in position on the weight mounting bar 1402 and adjacent the opposed sides 1406, 1408 of the central weight mounting base 1400.

Figure 15:
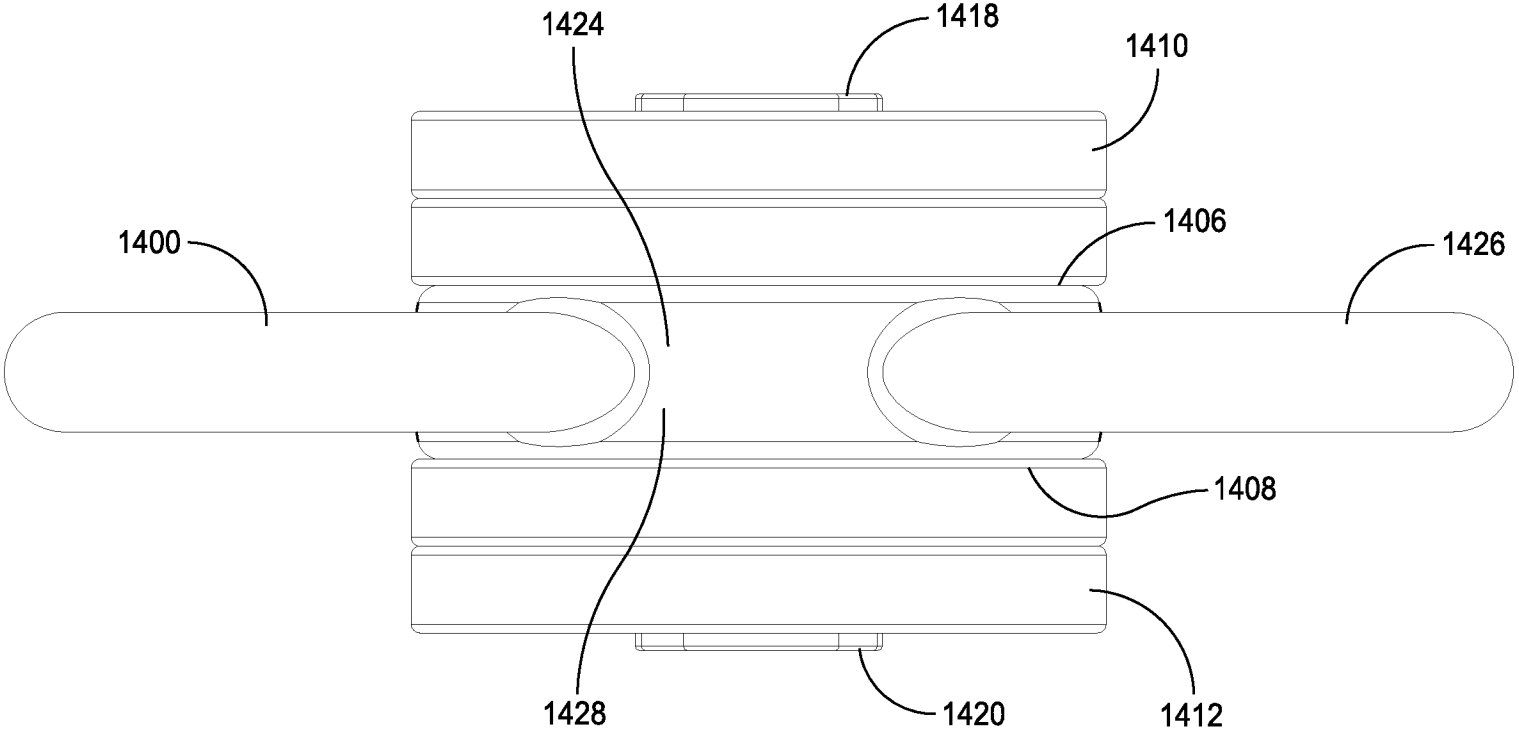
FIG. 15 is a top side elevational view of the fourth exercise apparatus embodiment of FIG. 14 assembled with the four conventional weight plates secured in position by mating threaded nuts threaded onto the threaded two-plate mounting rod (not shown in FIG. 14)

In the embodiment of FIGS. 14 and 15, an alternative technique for securing accessories, such as the exemplary opposed U-shaped handles 1424, 1426, has the accessories co-molded with, or alternatively welded to, the central weight mounting base 1400. This type of accessory-securing technique can be utilized with all or other accessories as desired. Similarly, many other accessory securing techniques may be utilized, some providing removability of the accessories and others permanently securing the accessory(ies) to the central weight mounting base 1400. Further, the structure of the weight mounting base may be different than as shown, such as with an external side 1428 more or less rounded than the generally flat (along its axial length parallel to the axis of the weight mounting bar 1402) external side 1428 shown in FIGS. 14 and 15.

Figure 16:
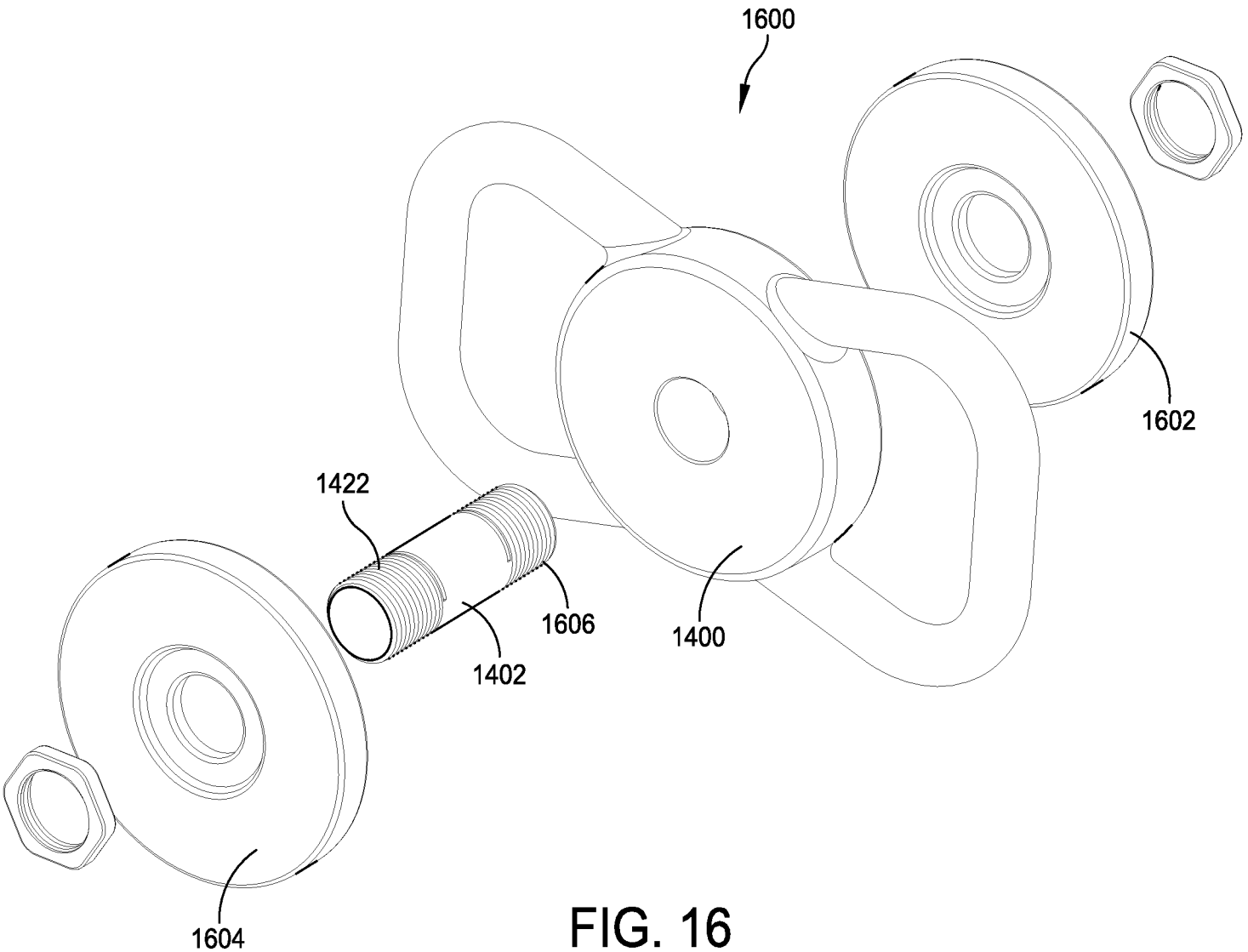
FIG. 16 is an exploded perspective view of a fifth exercise apparatus embodiment having two conventional weight plates mounted to its central weight plate mounting base via a threaded mounting rod passing through co-aligned passages in the weight plates and central weight plate mounting base.
Figure 18:
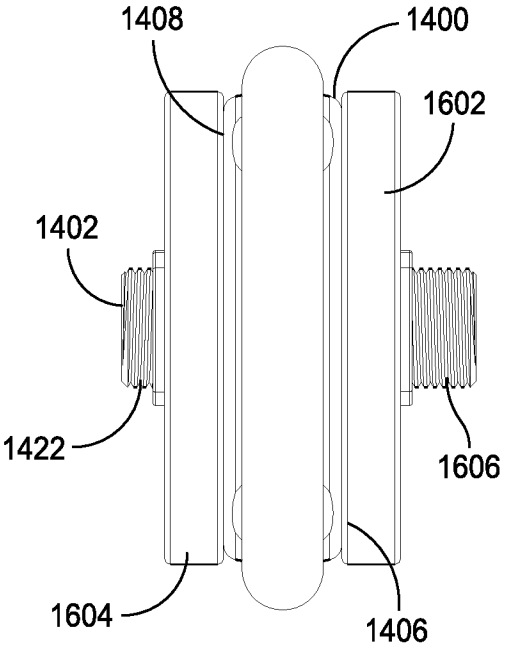
FIG. 18 is a left side elevational view of the assembled fifth exercise apparatus embodiment of FIG. 17.
Figure 17:
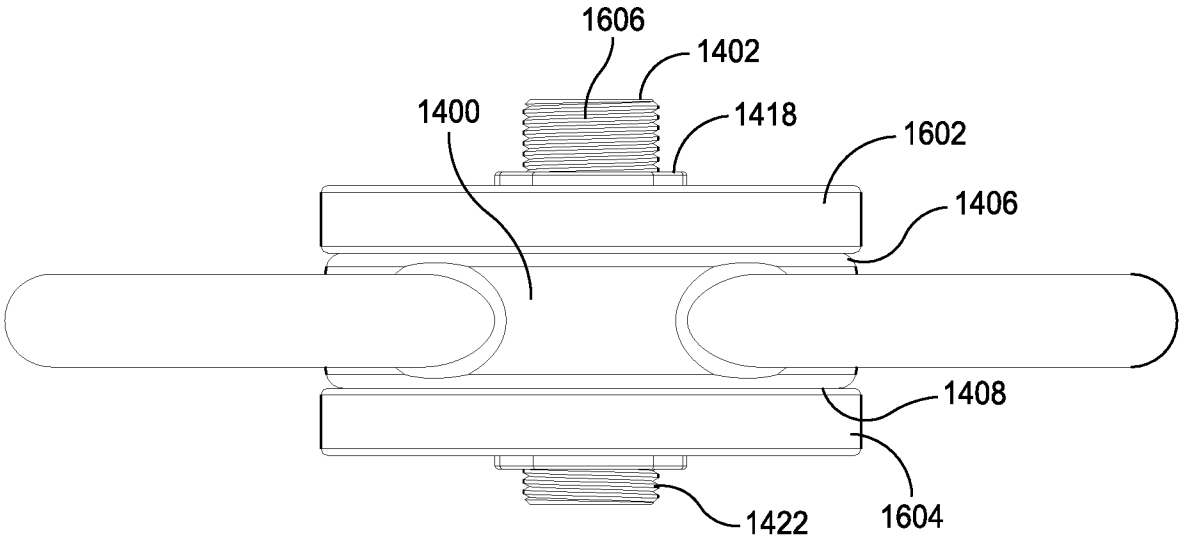
FIG. 17 is a top plan view of the fifth exercise apparatus embodiment of FIG. 16 with the two conventional weight plates secured in position by mating threaded nuts threaded onto opposed ends of the threaded mounting rod.

Referring now to FIG. 16-18, the central weight mounting base 1400 may utilize the same weight mounting bar 1402 to mount less than, for example, four weight plates as discussed with respect to FIGS. 14 and 15 above. For example, only two weight plates 1602, 1604, may be mounted respectively to the opposed, threaded ends 1422, 1606 of the weight mounting bar 1402. Alternatively, an optional, axially shorter weight mounting bar (not shown) may be utilized to reduce or eliminate exposed threaded ends 1422, 1606 from protruding axially outwardly and transversely from the central weight mounting base 1400 and associate weight plate(s), e.g., 1602, 1604, mounted to the opposed sides of the central weight mounting base 1400.

Figure 19:
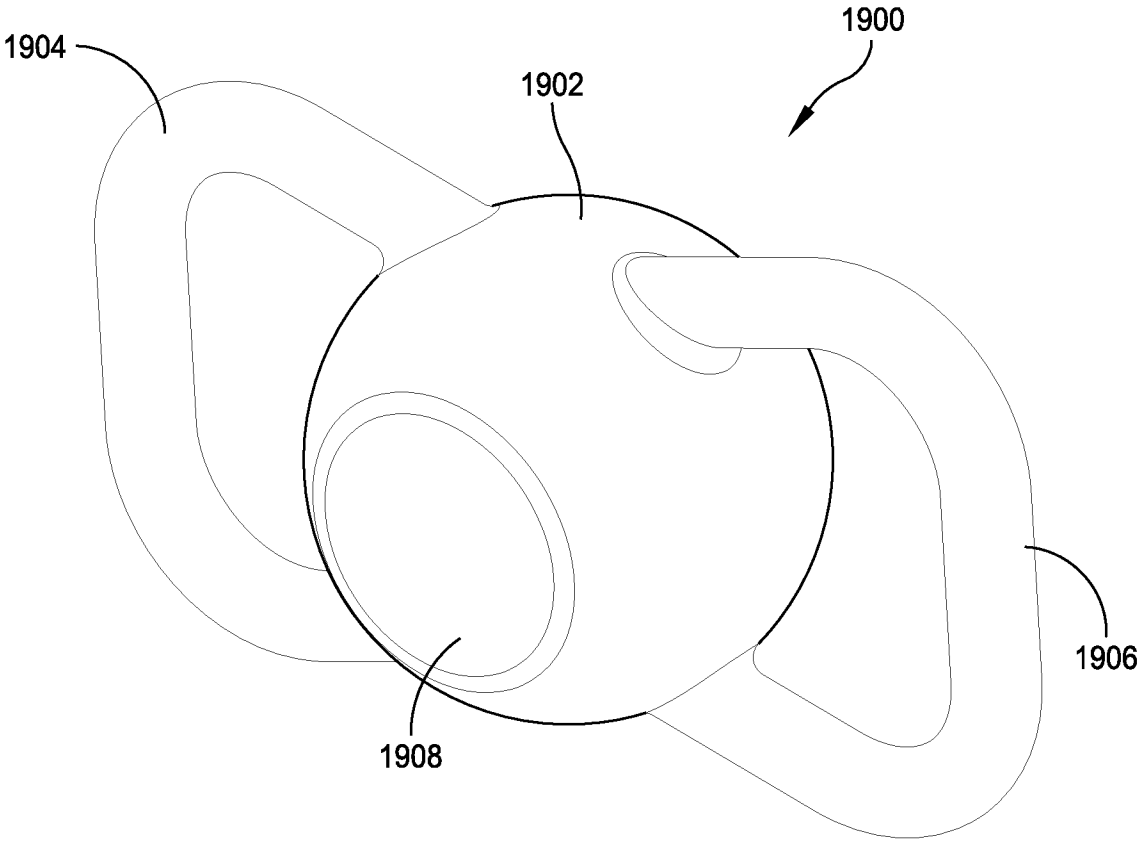
FIG. 19 is a perspective view of a sixth exercise apparatus embodiment have a central weight ball section with opposed U-shaped handles extending from opposite sides of the central weight ball section.
Figure 20:
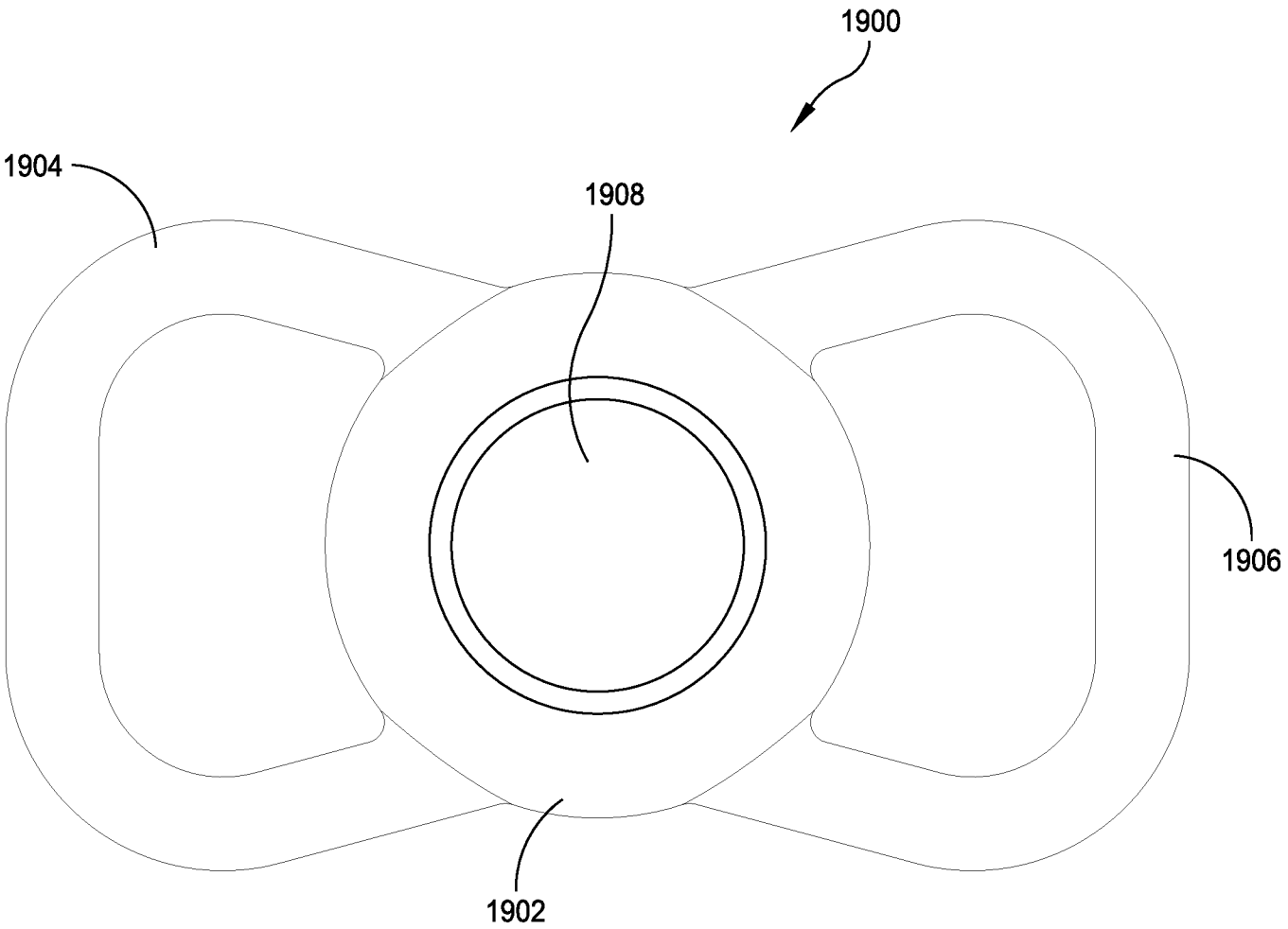
FIG. 20 is a top plan view of the seventh exercise apparatus embodiment of FIG. 19.

Referring now to FIGS. 19 and 20, a differing exercise apparatus embodiment 1900 may instead have a somewhat ball-shaped central base section 1902. Opposed U-shaped 1904, 1906 or other accessories may be mounted to central base section 1902. The central base section 1902 may have one or more planar external side portions, e.g., 1908. The accessories, e.g., 1904, 1906, may be co-molded or welded to the central base section 1902, or otherwise mounted, such as removably mounted, to the central base section 1902 in other ways such as disclosed in this specification, allowing the central base section 1902 be used with, and mounted to, yet other accessories such as those disclosed in this specification or others, optionally including fewer or more accessories.

Figure 22:
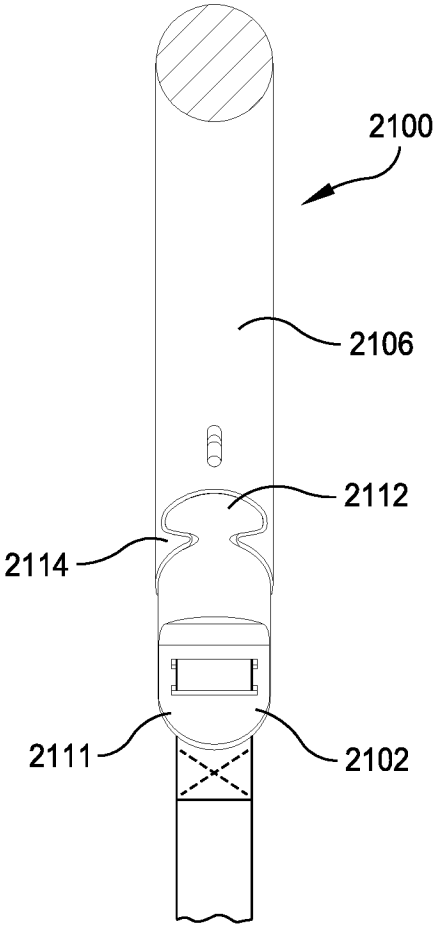
FIG. 22 is a cross-sectional view of the U-shaped exercise accessory taken along section line 22-22 of FIG. 21.
Figure 21:
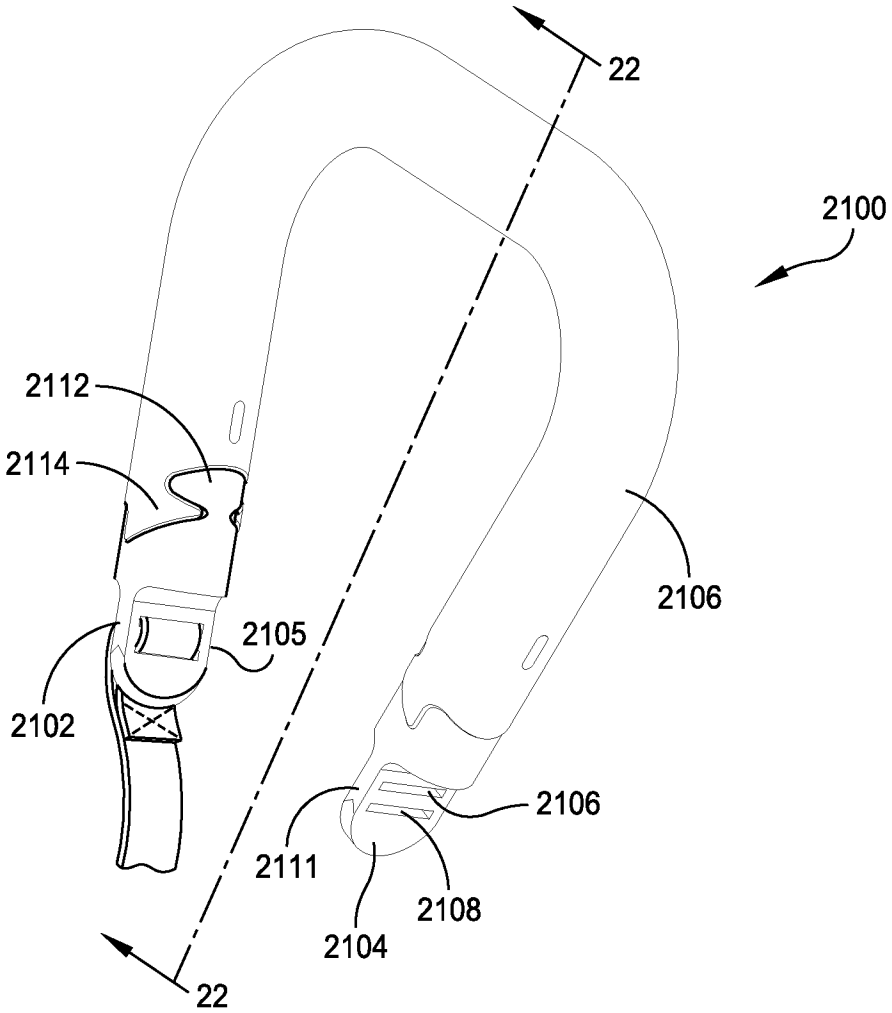
FIG. 21 is a perspective view of a U-shaped exercise accessory, which may optionally serve as a gripping handle or other connector, having two mounting strap slots in the end of each arm of the accessary.

With reference now to FIGS. 21 and 22, yet other apparatus exercise accessories, e.g., 2100, can include one or more strap securing structures, e.g., 2102, 2104. For example, a strap securing structure 2015 can include two parallel slots 2106, 2108 penetrating a flattened section 2110 in the accessory 2100. In the embodiment of FIGS. 21 and 22, the flattened section 2110 is at a strap mount end 2111 of a male dovetail mount, e.g., 2112. Thus, base accessories, e.g., 2106, having one or more mating opposed female dovetails, e.g., 2114, can be used with male dovetail 2112 to secure the flattened section's strap securing structure 2105 to the base accessory, e.g., 2100. Thus, the base accessories, e.g., 2106, can be useable for other purposes and exercises in addition to uses set forth above.

Figure 24:
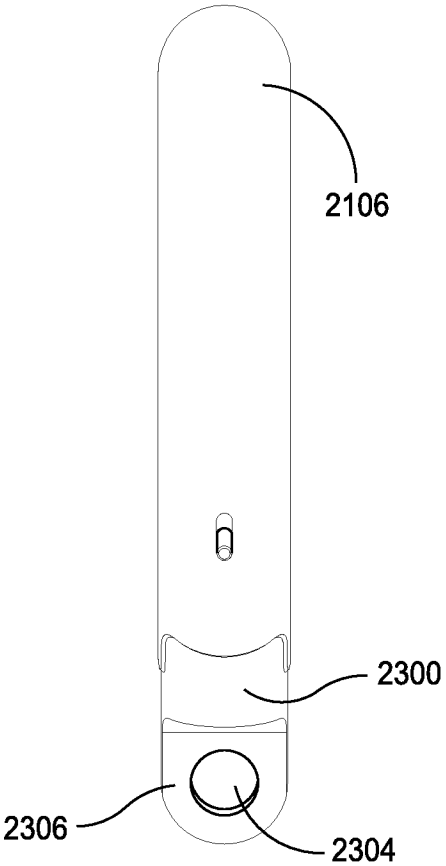
FIG. 24 is a right-side view of the second U-shaped exercise accessory of FIG. 23.
Figure 23:
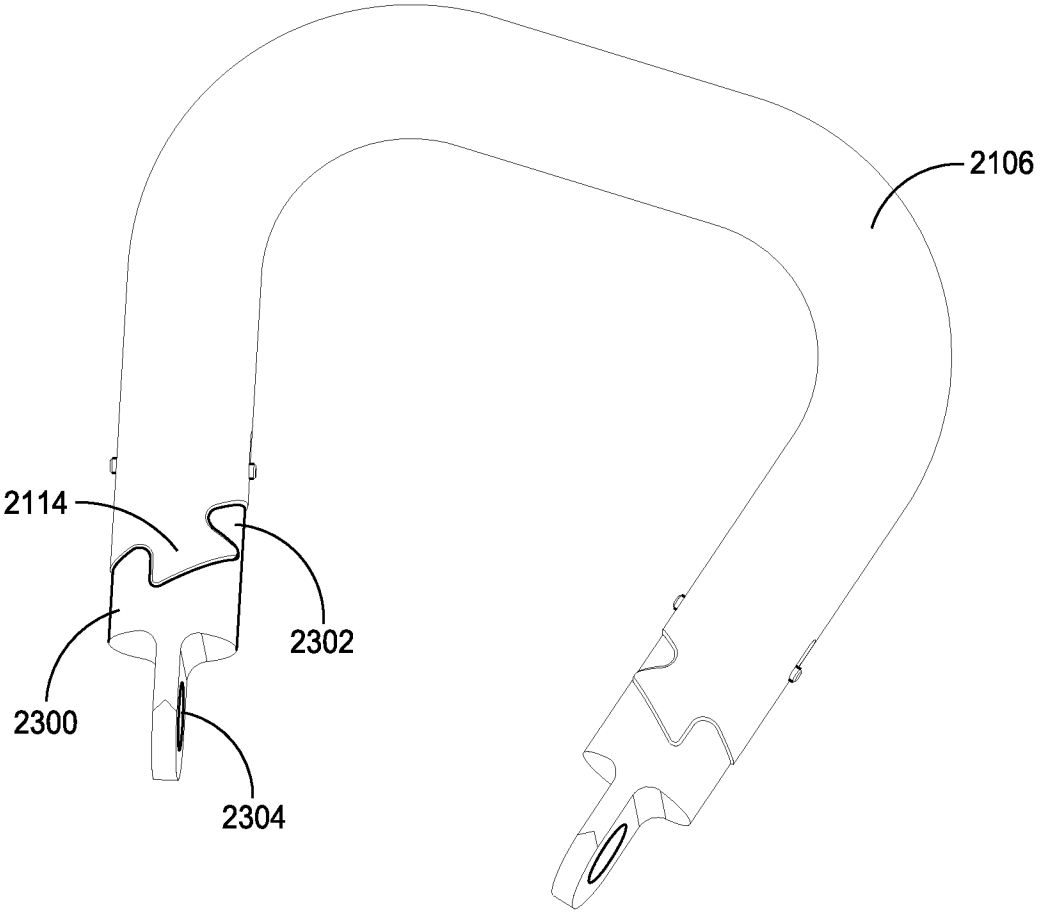
FIG. 23 is a perspective view of a second U-shaped exercise accessory, which may optionally serve as a gripping handle or other connector, having tubular mount in the end of each arm of the accessory.

With reference now to FIGS. 23 and 24, the base (or other) accessory 2106 can alternatively have one or more other types of connector 2300 dovetail ends, e.g., 2302, mounted respectively to one or more matingly dovetailed end, e.g., 2114, in the base accessory 2106. For example, the connector 2300 may have a slot or passage 2304 passing transversely to the flatted free end 2306 extending from the dovetail end 2302 of the connector 2300. Thus, one or more ropes, carabiners, or other devices (not shown) can be mounted to the accessory, e.g., 2106, by mounting the connector, e.g., 2300, to the exercise (or other) accessory.

Figure 26:
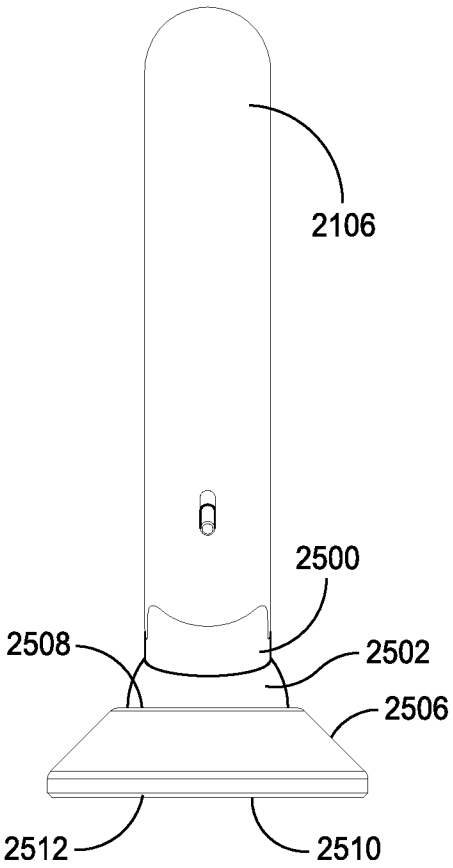
FIG. 26 is a right side elevational view of the third U-shaped exercise accessory of FIG. 25.
Figure 25:
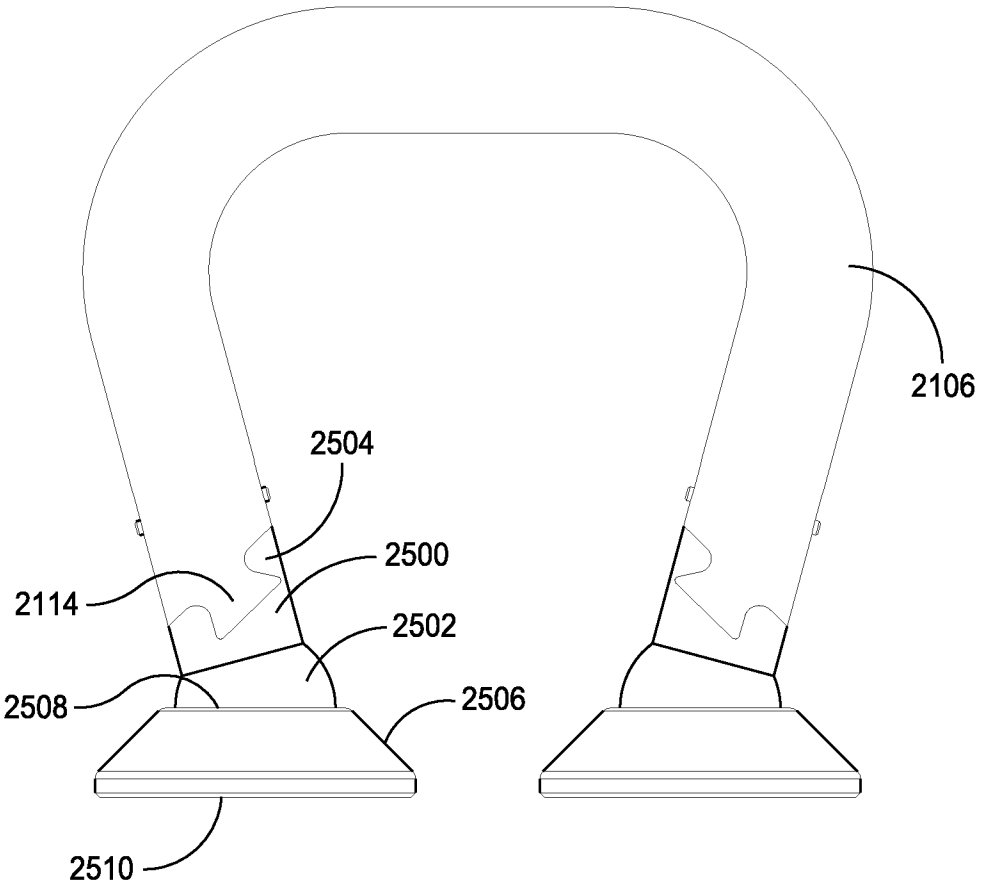
FIG. 25 is front elevational view of a third U-shaped exercise accessory, which may optionally serve as a gripping handle, having a mounting ball in the end of each arm of the accessory with a concave support rotatably mounted to the lower periphery of each mounting ball.

Referring to FIGS. 25 and 26, the base (or other) accessory 2106 can alternatively have yet another type of connector dovetail end, e.g., 2500, mounted respectively to one or more matingly dovetailed end, e.g., 2114, in the base accessory 2106. For example, the connector dovetail end 2500 may have a ball component 2502 intermediate the connector dovetail 2504 and a concave support end 2506. The ball component 2502 rotatably is mounted within the concave ball-surrounding-and-retaining surface (not shown) in the side 2508 of the concave support end 2506 opposite the free-standing planar support surface 2510 in the concave support end 2506. Thus, the resulting base accessory has one or more planar support surfaces, e.g., 2510, rotatable around the ball component 2502 including when the base accessory 2106 may me moved by a user (for example during a push-up with the user's two hands grasping two such exercise accessory handles 2106) with respect to a mating structure such as, for example, a planar floor surface (not shown) abutting the side 2512 of a planar support surface, e.g., 2510, opposite the ball component 2502.

Figure 27:
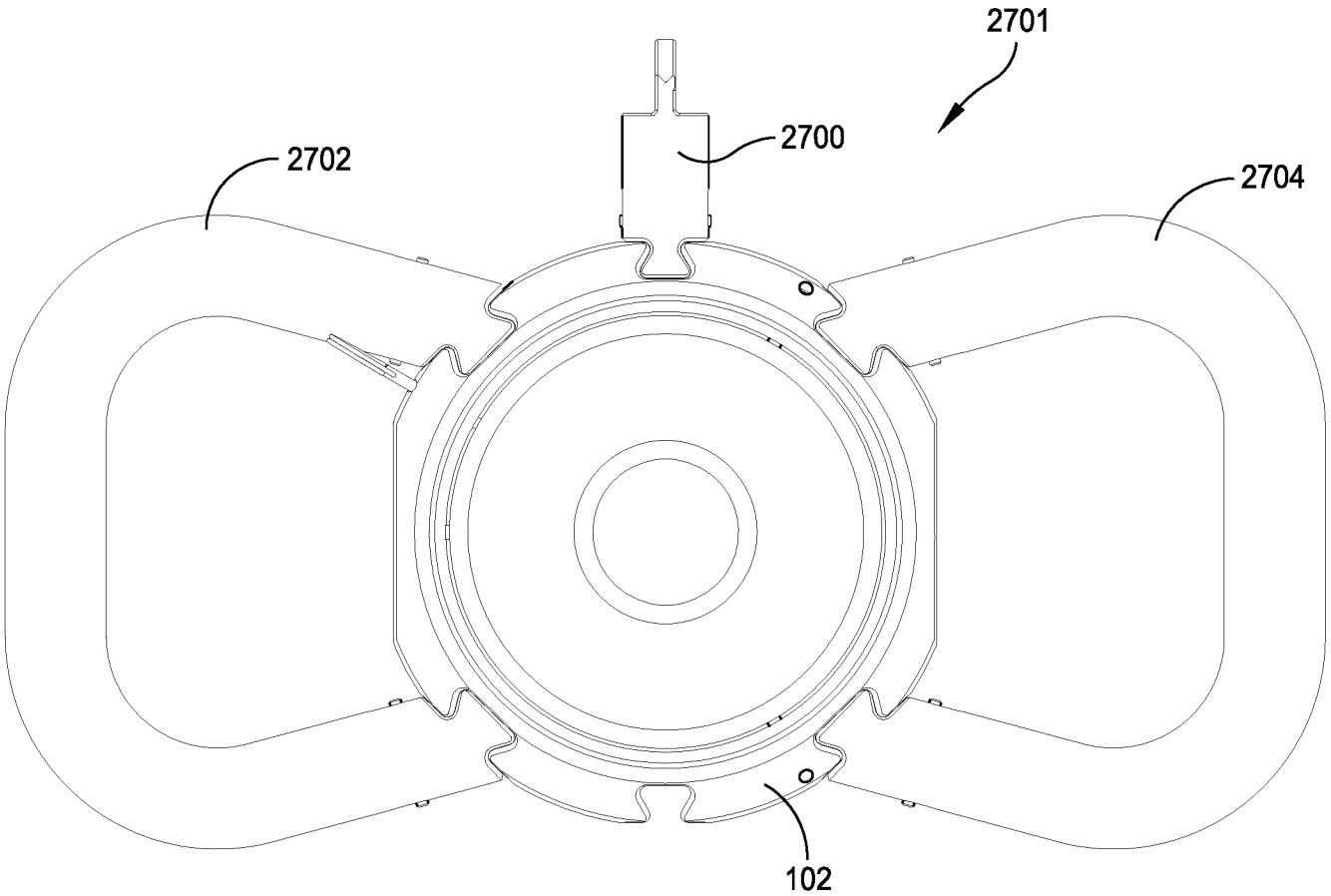
FIG. 27 is a top-side plan view of a sixth assembled exercise apparatus embodiment having a second type of accessory connector with a male dovetail mount slidably mounted in a female dovetail mount or slot in the outer peripheral side of the central weight plate mount.
Figure 30:
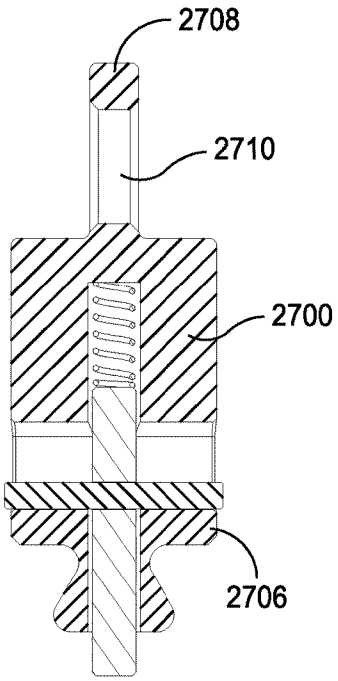
FIG. 30 is a cross-sectional view of the second accessory connector taken along section line 21-21 of FIG. 21.
Figure 32:
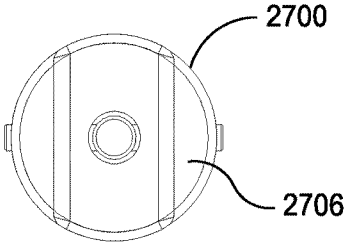
FIG. 32 is a bottom plan view of the second accessory connector of FIG. 22.
Figure 29:
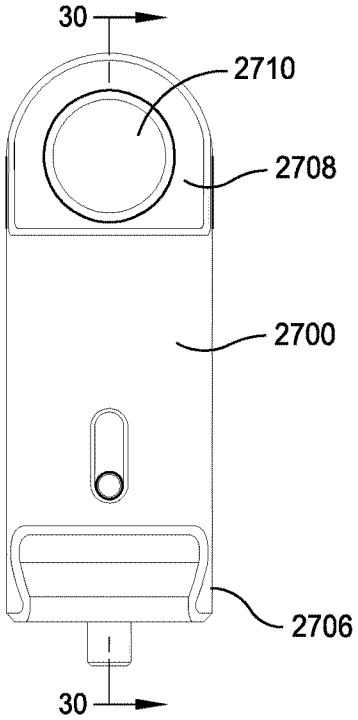
FIG. 29 is right side elevational view of the second accessory connector of FIG. 20.
Figure 31:
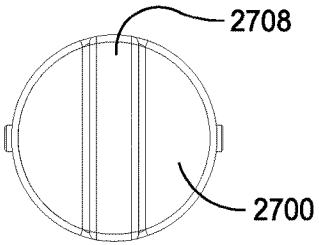
FIG. 31 is a top plan view of the second accessory connector of FIG. 22.
Figure 28:
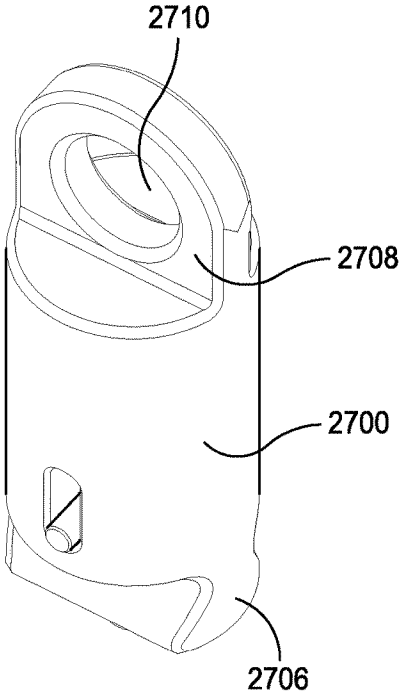
FIG. 28 is a perspective view of the second accessory connector shown in FIG. 19.

Turning now to FIG. 27, a central plate mounting base 102 can have yet a differing type of connector assembly 2700 mounted to the base 102 to extend radially outwardly from the base 102, for example, intermediate two oppose U-shaped exercise accessory handles 2702, 2704. With reference to FIGS. 28-32, the connector assembly 2700 has a male dovetail mounting end 2706 opposite a thinned connecting end 2708 having a connector passage 2710 transversely passing through the thinned connecting end 2708.

The exercise apparatus embodiment 2701 of FIGS. 27-32 can be used to perform a variety of exercises the other weight systems, such as by mounting the connecting end 2708 to cables on cable-weight machines, or to ropes or cables having weights secured to one end and the other end secured to the connecting end 2708 with the rope or cable passed over a tree limb, a swing-set cross-bar, or other structure.

Figure 33:
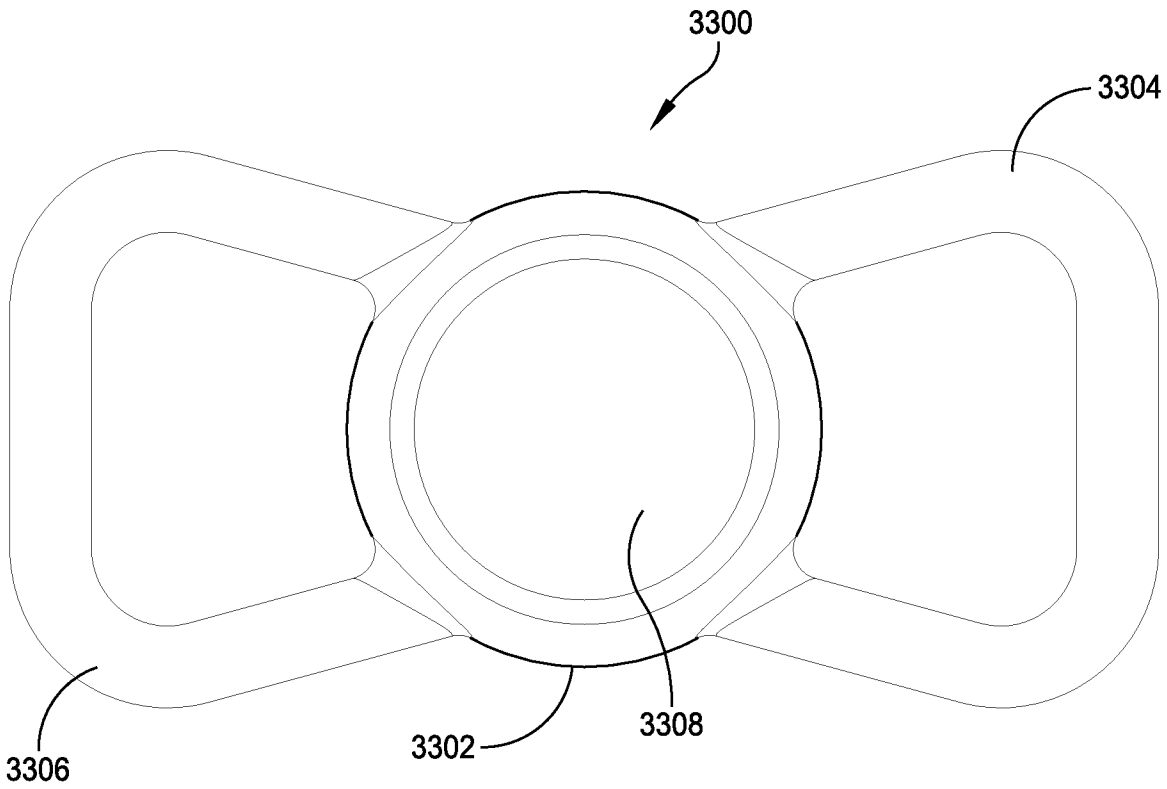
FIG. 33 is a top plan view of an eighth exercise apparatus embodiment having two opposed U-shaped handles extending at an angle from a central somewhat ball-shaped bell.
Figure 34:
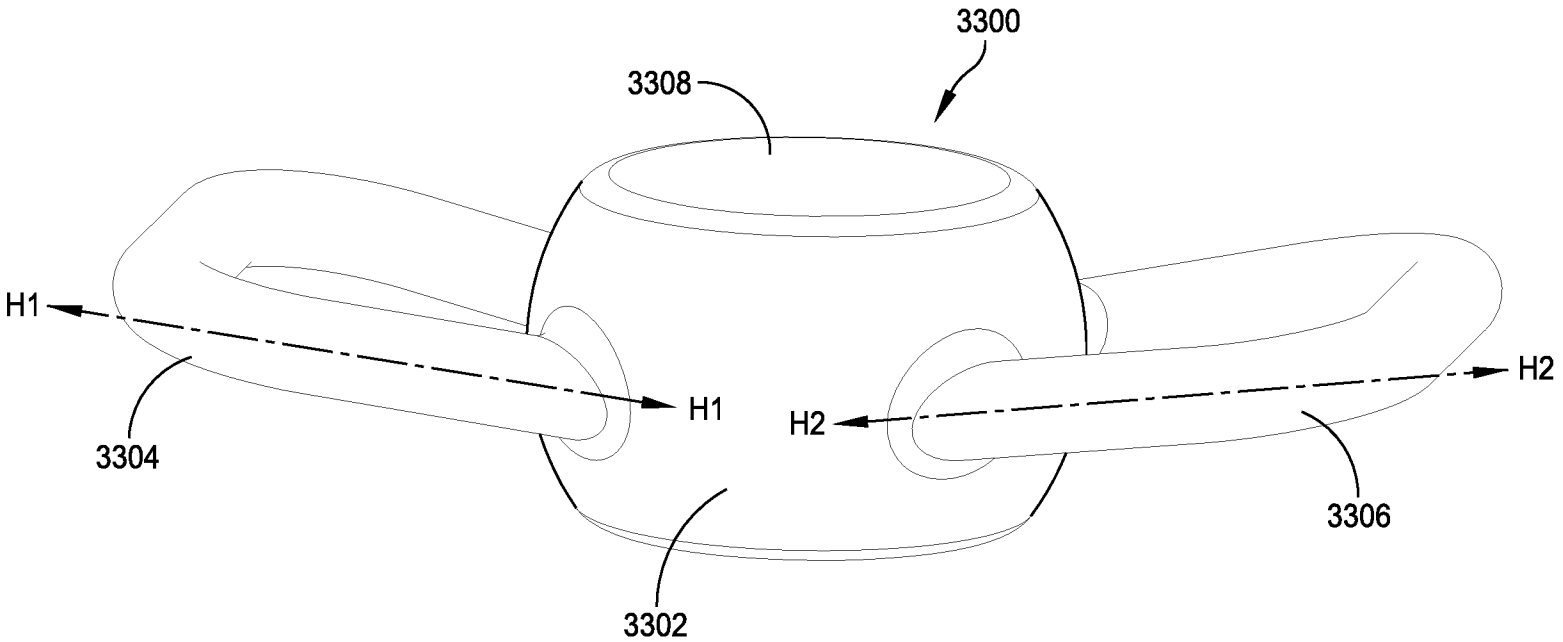
FIG. 34 is a perspective view of the exercise apparatus embodiment of FIG. 33.

With reference to FIGS. 33 and 34, a further exercise apparatus embodiment 3300 may instead have a somewhat ball-shaped central base section 3302. Opposed U-shaped 3304, 3306 or other accessories may be mounted to central base section 3302 to extend at an angle, such as from 5 to 60 degrees (for example 10 degrees as shown in FIG. 34) to the plane of a planar external side portion, e.g., 3308, in the somewhat ball-shaped central base section 3302. Said another way with respect to the depicted U-shaped arms or handles 3304, 3306, their respective arms each have centerlines, C1-C1 and C2-C2 respectively, that cooperatively form an obtuse angle of 5 to 60 degrees (for example 20 degrees as shown in FIG. 34). Stated yet another way, the opposed U-shaped arms are not coplanar as in the case of the FIGS. 19 and 20 embodiment.

The accessories, e.g., 3304, 3306, may be co-molded with, or welded to, the central base section 3302, or otherwise mounted, such as removably mounted, to the central base section 3302 in other ways such as disclosed in this specification, allowing the central base section 3302 be used with, and mounted to, yet other accessories such as those disclosed in this specification or others, optionally including fewer or more accessories. In some uses, the angled, opposed U-shaped accessories 3304, 3306 may be gripped by user's left and right hands respectively in order to, for example, perform exercises with the exercise apparatus 3300 that more reliably space the ball-shaped central base section 3302 further away from the user's hands and arms, and away from the user's body as the central base section and associated U-shaped handles are moved by the user's hand in exercising with the further exercise apparatus embodiment 3300.

Figure 35:
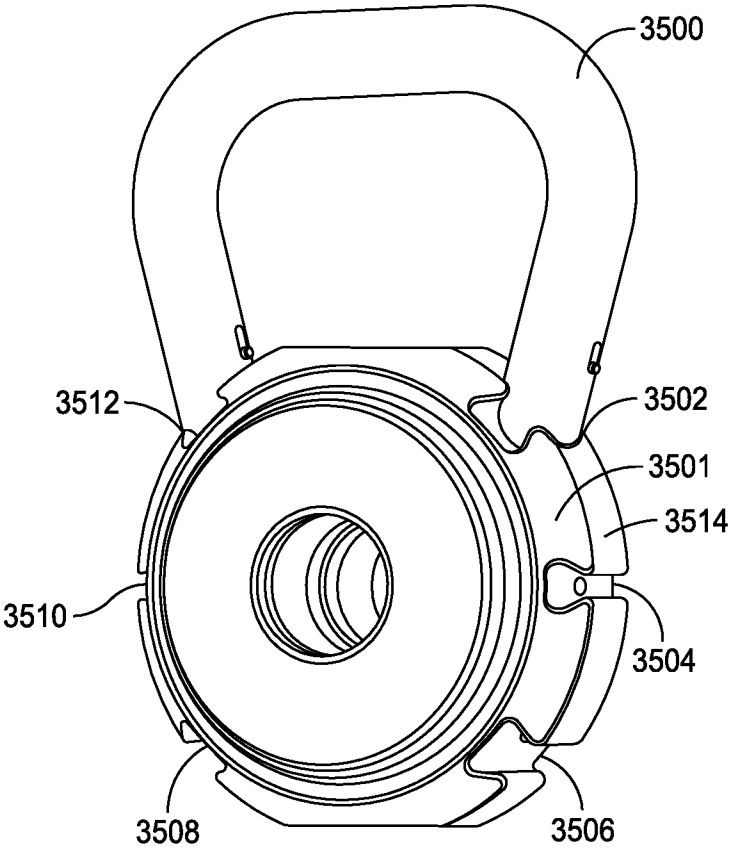
FIG. 35 is a perspective view of a ninth exercise apparatus embodiment having a central weight plate mounting base with a single accessory removably mounted to the central weight plate mounting base, with the single accessory shown being a U-shaped handle.

Referring now to FIG. 35, the central weight plate mounting base 3501 may have only one exercise accessory, e.g., 3500, removably or otherwise mounted to the mounting base 3501. In the embodiment of FIG. 35, the exercise accessory is a U-shaped handle 3500, but the particular exercise accessory can be any of the accessories disclosed herein and yet other exercise accessory shapes as well.

Figure 36:
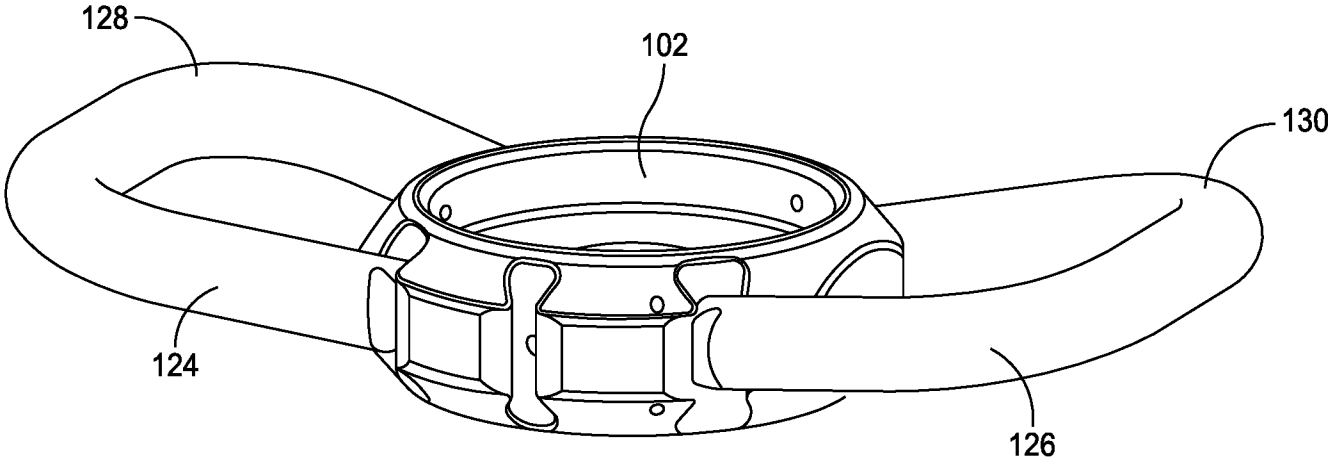
FIG. 36 is a side elevational view of a ninth exercise apparatus embodiment with two opposed U-shaped handles being at an acute angle to the central axis A1-A1 extending through the center of the central weight plate mounting base.
Figure 37:
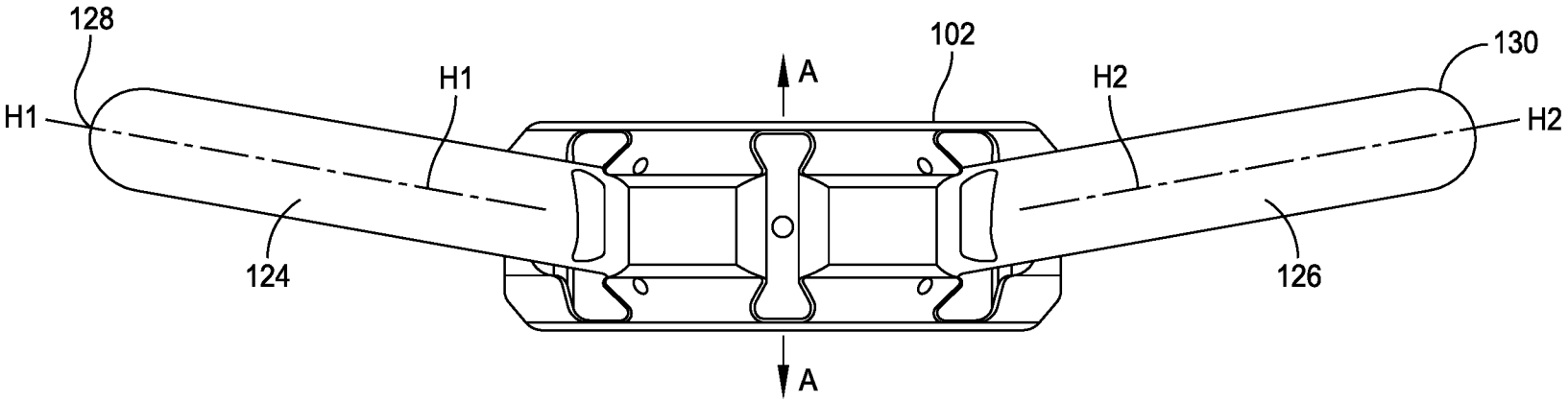
FIG. 37 is a perspective view of the exercise apparatus embodiment of FIG. 36.

Turning to FIGS. 36 and 37, this exercise apparatus embodiment can be made from, with reference to FIG. 2, the same types of accessory mounting dovetail structure as employed for mounting the U-shaped accessory handles 124, 126 to the central weight plate mounting base 102 of FIG. 2, except that the dovetail component angles, or other handle mounting structures, are altered to align the laterally extending axis H1-H1, H2-H2 of the handles 124, 126, respectively, so these axis H1-H1, H2-H2 cooperatively form a 20 degree angle between them. Such accessory handle mounting structures could be adjusted to provide a differing such angle, such as an obtuse angle, for example from 5 to 60 degrees. The particular such angle can be chosen, if desired, so that the handles 124, 126 provide that the central mounting base 102 is as spaced away as desired from the outer ends 128, 130 of the handles 124, 126, respectively, and minimizing, as desired, contact of the central mounting base 102 with other structures or the user's body during exercising.

It is to be understood that the U-shaped handles disclosed above may have any of many other shapes. They may be more rounded or have more straightened sections for example.

Similarly, various of the exercise bar, handle, and connector components may have tubular or other structure that is not necessarily solid within the confines of outer periphery or other structure in the bar, handle, or connector components.

What I claim is:

1. An exercise apparatus system of the type useable with a removable weight, the exercise apparatus comprising:

a central weight mounting base having (i) a central weight mounting cavity in which the removable weight is removably mountable, (ii) an outer peripheral accessary mounting side section surrounding at least a portion of the central weight mounting cavity, (iii) a plurality of system accessory mounts on the mounting side section and to which at least one weight lifting bar is removably mountable to at least one of the plurality of system accessory mounts in the mounting side section of the central weight mounting base;

wherein: (a) the central weight mounting cavity has a central axis extending from and transverse to the central weight mounting base through the central weight mounting cavity; and (b) at least one of the plurality of system accessory mounts comprises a weight lifting bar mounting slot penetrating the mounting side section and extending parallel to the central axis, whereby the one weight lifting bar is removably mountable to the mounting side section by sliding an end of the weight lifting bar within the weight lifting bar mounting slot parallel to the central axis of the central weight mounting cavity.

2. The exercise apparatus of claim 1 wherein at least a second weight lifting bar is removably mountable to at least a second of the plurality of system accessory mounts in the mounting side section of the central weight mounting base.

3. The exercise apparatus of claim 2 wherein at least a third weight lifting bar is removably mountable to at least a third of the plurality of system accessory mounts in the mounting side section of the central weight mounting base.

4. The exercise apparatus of claim 3 wherein at least a fourth weight lifting bar is removably mountable to at least a fourth of the plurality of system accessory mounts in the mounting side section of the central weight mounting base.

5. The exercise apparatus of claim 4 wherein a connector accessory is removably mountable to the one or another among the plurality of system accessory mounts in the mounting side section of the central weight mounting base, whereby the connector accessory may connect to a further exercise accessory.

6. The exercise apparatus of claim 5 wherein the central mounting base has a center point and each among the plurality of system accessory mounts are equidistant from the center point in the central mounting base.

7. The exercise apparatus of claim 6 wherein the removable weight is a weight plate having a circular outer periphery.

8. The exercise apparatus of claim 3 wherein a connector accessory is removably mountable to the one or another among the plurality of system accessory mounts in the mounting side section of the central weight mounting base, whereby the connector accessory may connect to a further exercise accessory.

9. The exercise apparatus system of claim 3 wherein at least four among the plurality of system accessory mounts are equidistant from a central point in the central weight mounting base.

10. The exercise apparatus of claim 2 wherein a connector accessory is removably mountable to the one or another among the plurality of system accessory mounts in the mounting side section of the central weight mounting base, whereby the connector accessory may connect to a further exercise accessory.

11. The exercise apparatus of claim 1 wherein a connector accessory is removably mountable to the one or another among the plurality of system accessory mounts in the mounting side section of the central weight mounting base, whereby the connector accessory may connect to a further exercise accessory.

12. The exercise apparatus of claim 1 wherein the central mounting base has a center point and each among the plurality of system accessory mounts are equidistant from the center point in the central mounting base.

13. The exercise apparatus of claim 12 wherein the removable weight is a weight plate having a circular outer periphery.

14. The exercise apparatus of claim 1 wherein the removable weight is a weight plate having a circular outer periphery.

15. The exercise apparatus system of claim 1 wherein the central weight mounting base has a central point surrounded by system the accessory side mounting section and at least two among the plurality of system accessory mounts are equidistant from the central point in the central weight mounting base.

16. The exercise apparatus system of claim 15 wherein at least six among the plurality of system accessory mounts are equidistant from the central point in the central weight mounting base.

17. The exercise apparatus of system of claim 1 wherein the central weight plate mounting cavity in the central weight mounting base is opposite a a second weight plate mounting cavity in the central weight mounting base.

18. The exercise apparatus system of claim 1 wherein each of the plurality of system accessory mounts comprises a weight lifting bar mounting slot penetrating the mounting side section and extending parallel to the central axis.

19. The exercise apparatus of claim 18 wherein each weight lifting bar mounting slot has a female dovetail mounting channel and the end of the weight lifting bar has a mating male dovetail end.

20. The exercise apparatus system of claim 1 wherein the weight lifting bar mounting slot has a female dovetail mounting channel and the end of the weight lifting bar has a mating male dovetail end.

* * * * *